US007214460B2

(12) United States Patent
Ishii et al.

(10) Patent No.: US 7,214,460 B2
(45) **Date of Patent: *May 8, 2007**

(54) YELLOW TONER

(75) Inventors: Atsushi Ishii, Shizuoka (JP); Takaaki Kotaki, Shizuoka (JP); Satoshi Matsunaga, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/223,989

(22) Filed: Sep. 13, 2005

(65) Prior Publication Data

US 2006/0008726 A1 Jan. 12, 2006

Related U.S. Application Data

(62) Division of application No. 10/681,272, filed on Oct. 9, 2003, now Pat. No. 7,056,634.

(30) Foreign Application Priority Data

Oct. 10, 2002 (JP) ..... 2002-297410
Oct. 30, 2002 (JP) ..... 2002-315438

(51) Int. Cl.
*G03G 9/087* (2006.01)

(52) U.S. Cl. ..... 430/108.23; 430/109.3; 430/109.4

(58) Field of Classification Search ..... 430/108.23, 430/109.3, 109.4, 108.8
See application file for complete search history.

(56) References Cited

U.S. PATENT DOCUMENTS 5,562,075 A 10/1996 Walsh ..... 430/45

(Continued)

FOREIGN PATENT DOCUMENTS

JP 08-234489 9/1996

(Continued)

OTHER PUBLICATIONS

Diamond, A.S., "Handbook of Imaging Materials", New York, Marcel Dekker, Inc., (1991), pp. 163-170.

(Continued)

*Primary Examiner*—Christopher RoDee
(74) *Attorney, Agent, or Firm*—Fitzpatrick, Cella, Harper & Scinto

(57) ABSTRACT

To provide a yellow toner allowing formation of an image with an excellent transparency for an OHP, an excellent coloring power, and an excellent light resistance. In the yellow toner including at least a yellow pigment containing a monoazo compound represented by the following formula (1), the value of a* is in the range of −5 to +14 when b* is +80 with respect to a transmission chromaticity of an image formed on a transparency sheet.

Formula (1)

(wherein $X_1$ to $X_6$ each independently denotes a substituent selected from the group consisting of a hydrogen atom, a C1–3 alkyl group, a C1–3 alkoxyl group, a nitro group, a halogen group, a sulfonic group, a sulfamoyl group, a sulfamoyl group substituted with an aromatic group, a carboxyl group, and a carboxylate; each may bond with another to form a benzene ring or an imidazolone ring.)

6 Claims, 4 Drawing Sheets

U.S. PATENT DOCUMENTS

| | | | | |
|---|---|---|---|---|
| 6,620,566 | B1 | 9/2003 | Yamauchi | 430/45 |
| 2001/0023048 | A1 | 9/2001 | Shoji et al. | 430/110.3 |
| 2004/0202952 | A1 | 10/2004 | Albright et al. | 430/137.14 |

FOREIGN PATENT DOCUMENTS

| | | |
|---|---|---|
| JP | 10-171165 | 6/1998 |
| JP | 2000-63694 | 2/2000 |
| JP | 2001-166540 | 6/2001 |
| JP | 2001-228653 | 8/2001 |
| JP | 2003-149859 | 5/2003 |

OTHER PUBLICATIONS

Machine Translation of JP10-171165 (Jun. 1998).

Sharma, G. , "Digital Color Imaging Handbook", Boca Raton: CRC Press (Dec. 2002), pp. 30-32.

YELLOW TONER

CROSS-REFERENCE TO RELATED APPLICATION

This application is a division of application Ser. No. 10/681,272, filed on Oct. 9, 2003, now U.S. Pat. No. 7,056,634.

BACKGROUND OF THE INVENTION

1. Field of the Invention

The present invention relates to a toner used for developing an electrostatic image formed in a process for forming an image, such as an electrophotographic process, an electrostatic recording process, and an electrostatic printing process.

2. Description of the Related Art

A full-color copier includes four image bearing members and an endless intermediate transfer member. The full-color copier forms a desired color image by: forming an electrostatic image on each of the image bearing members; developing the formed electrostatic images using a cyan toner, a magenta toner, a yellow toner, and a black toner, respectively; transferring toner images of the respective colors formed by the development on a transfer material such as an overhead transparency sheet (so-called OHP sheet) or a piece of ordinary paper so as to finally overlap the toner images; and fixing the toner images overlapped on the transfer material to the transfer material.

Therefore, the color toners are required to have a transparency enough to prevent the color of an upper layer from becoming a hindrance to the color of a lower layer when the colors of these layers are mixed. When an image formed on an OHP sheet is projected onto a screen, the chromaticity of the image projected on a screen through an OHP may differ from the expected if the transparency of toner is inferior, resulting in an undesired color. From this viewpoint, a high transparency is needed as well. In particular, humans are highly sensitive to a variation in hue angle of yellow and tend to easily recognize a variation in chromaticity of transmitted light. Therefore, the high transparency of a toner is particularly important.

Up to now, a monoazo compound has been known as a yellow pigment. The monoazo yellow pigment is excellent in color tint and coloring power of reflected light, so that it is desired to be used for a color toner. However, the monoazo yellow pigment has property of easily allowing the growth of primary particles and aggregation thereof upon the maturing of a pigment with heat after synthesis. For increasing the transparency of a toner, there is a need of reducing a dispersed particle size of a pigment in the toner. When the primary particles become large or aggregate, a problem will tend to occur with respect to the transparency of the toner. For solving the problem, several processes have been disclosed in the art, including a process having a so-called master batch step in which a pigment is mixed with a part of a binder resin in advance, a process in which a pigment is provided without being dried and used in a form of paste containing water to prevent the growth of particles therein, and a process in which a raw material containing a sulfonyl group and a raw material containing a benzimidazolone group are mixed in small amounts during a preparation of a pigment by a coupling reaction in order to keep the primary particle size of the pigment minimum (see JP 2001-166540 A, JP 08-234489 A, and JP 2000-63694 A).

However, even when the master batch is conducted or the pigment in a paste form is used, the dispersion of pigment particles is not yet sufficient, and thus an excellent color tint inherent in the monoazo yellow pigment is not sufficiently brought out when an image is projected to a screen through the OHP. The process for mixing the raw material containing the sulfonyl group and the raw material containing the benzimidazolone group in small amounts exerts an effect of preventing the growth in primary particle size of the pigment, but the pigment itself changes a color tint. Therefore, the excellent color tint inherent in the monoazo yellow pigment is not sufficiently brought out.

Further, there is another proposal in which the dispersion particle size of a monoazo yellow pigment in a toner is controlled (JP 2001-228653 A). In this case, however, the color tint of a transmitted image is not considered.

Furthermore, there is another proposal to improve the clarity of color hue and the transparency of an image on the OHP sheet by using of a pigment composition in which two or more different monoazo yellow pigments are mixed together for a toner (JP 10-171165 A). In this case, however, comprehensive studies are not sufficiently conducted, such as studies on the toner formulation and process for preparing the toner, so that there is still room for improvement.

Consequently, a yellow toner having a more excellent transparency and a more excellent color tint of an OHP transmitted image through an OHP sheet has been desired in the art.

SUMMARY OF THE INVENTION

An object of the present invention is to solve the above-mentioned problems of the prior arts and provide a yellow toner having a satisfactory transparency for an OHP.

Another object of the present invention is to provide a yellow toner having a satisfactory coloring power and a satisfactory light resistance.

A further another object of the present invention is to provide a yellow toner allowing the formation of an image with an excellent color tint even on an OHP transmitted image.

A still further another object of the present invention is to provide a yellow toner having excellent color mixing property of a secondary color and a wide range of color reproduction.

The present invention relates to a yellow toner including a yellow toner particle that contains at least a binder resin, a wax, and a yellow pigment containing a monoazo compound represented by the following formula (1), in which a value of a* is in the range of −5 to +14 when b* is +80 with respect to a transmission chromaticity of an image formed on a transparency sheet using the toner.

Formula (1)

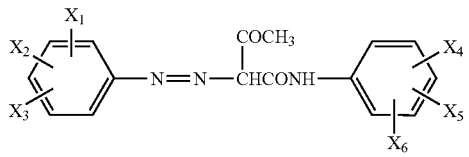

(wherein $X_1$ to $X_6$ each independently denotes a substituent selected from the group consisting of a hydrogen atom, a C1–3 alkyl group, a C1–3 alkoxyl group, a nitro group, a halogen group, a sulfonic group, a sulfamoyl group, a sulfamoyl group substituted with an aromatic group, a carboxyl group, and a carboxylate; each may bond with another to form a benzene ring without a substituent or an imidazolone ring without a substituent; or each may bond with another to form a benzene ring with above-mentioned substituent or an imidazolone ring with above-mentioned substituent.)

BRIEF DESCRIPTION OF THE DRAWINGS

Other objects and advantages of the present invention will become apparent during the following discussion, in conjunction with the accompanying drawings, in which.

DETAILED DESCRIPTION OF THE PREFERRED EMBODIMENTS

Figure 1:
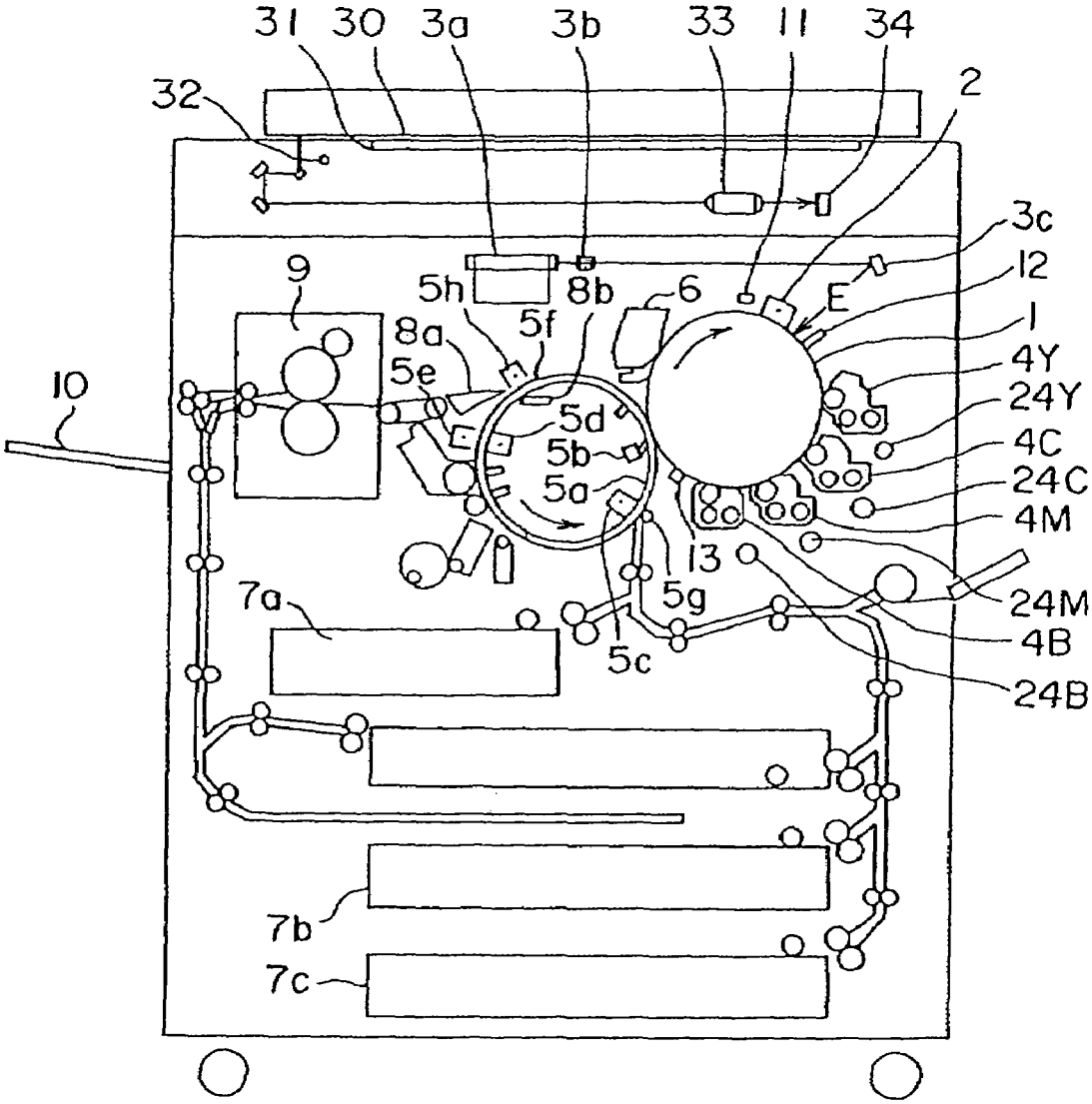
FIG. 1 is a schematic cross sectional diagram showing an example of an image forming apparatus using a toner of the present invention.

The toner of the present invention contains a specific monoazo yellow pigment as a colorant with the hue of a transmitted color in a specific range, which is capable of obtaining a fixed image having an excellent transparency and color mixing property.

In the toner of the present invention, when b* is +80, a value of a* is essentially in the range of −5 to +14, preferably in the range of −5 to +12, more preferably in the range of 0 to +10, still more preferably in the range of 0 to +8 with respect to the transmission chromaticity of an image formed on a transparency sheet. If the value of a* is in the range of −5 to +14, the toner has an appropriate color hue for a transmitted yellow image.

According to the present invention, the binder resin of the toner preferably contains as a main component at least one of a polyester resin and a hybrid resin in which a graft polymer is formed from a vinyl polymer unit and a polyester unit. Here, the term "hybrid resin" means a resin composition in which a polyester unit and a vinyl polymer unit obtained by polymerizing monomers having carboxylate ester groups such as (meth)acrylate esters or a vinyl polymer unit obtained by polymerizing monomers having carboxylic acid groups such as (meth)acrylic acids form a graft polymer by an ester exchange reaction or a polycondensation reaction. Preferably, the polyester resin used may be a linear polyester resin. By using the polyester resin or the hybrid resin as a main component, the transmissivity of an image can be further increased when it is designed to have a softening temperature nearly equal to that of another resin, allowing the color of an image projected to a screen through an OHP to be more vivid.

The binder resin to be used in the toner of the present invention is preferably one having a THF soluble fraction that shows a peak in the region corresponding to a molecular weight of 3,000 to 15,000 in a chromatogram obtained by a gel permeation chromatography (GPC) and a weight average molecular weight (Mw)/number average molecular weight (Mn) ratio of 2 to 100. More preferably, the binder resin is one having a peak in the region corresponding to a molecular weight of 4,000 to 12,000 and an Mw/Mn ratio of 2.2 to 50. Further preferably, the binder resin is one having a peak in the region corresponding to a molecular weight of 6,000 to 10,000 and an Mw/Mn of 2.5 to 30. When the binder resin has a peak in the region corresponding to a molecular weight of 3,000 to 15,000 and an Mw/Mn ratio of 2 to 100, the transmissivity of an image will be high, and a more vivid image projected on a screen through an OHP can be obtained.

The binder resin of the toner of the present invention preferably contains 30% by mass or less of THF insoluble fraction, more preferably 0.5 to 15% by mass of THF insoluble fraction, more preferably 1 to 10% by mass of THF insoluble fraction, based on the total resin composition. When the binder resin contains 30% by mass or less of THF insoluble fraction, the transmissivity of an image will be high and a more vivid image projected on a screen through an OHP can be obtained, while allowing an increase in color mixing property of a secondary color.

The toner of the present invention contains a wax. The wax is preferably one having at least one of an endothermic peak and a shoulder in the range of 65 to 120° C., more preferably of 70 to 110° C., still more preferably of 75 to 100° C., in a DSC curve measured by a differential scanning calorimeter (DSC) during a temperature rising. In this case, the fixing ability of the toner and the transparency of an image can be favorably attained simultaneously.

Under a load of 500 g at a temperature of 120° C., the toner of the present invention is preferably one having a deformation of 65 to 85%, more preferably one having a deformation of 75 to 80%. When the toner has a deformation of 65 to 85%, the transmissivity of an image will be high, and a more vivid image will be projected on a screen through an overhead projector while allowing an increase in color mixing property of a secondary color.

In the toner of the present invention, the polyester resin or the polyester unit used for the hybrid resin may be prepared from alcohol and carboxylic acid, carboxylic anhydride, carboxylic acid ester, or the like as a raw material monomer.

Specific examples of the dihydric alcohol component include alkylene oxide adducts of bisphenol A such as polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane; ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A, and hydrogenated bisphenol A.

Examples of the alcohol component that has three or more hydroxyl groups include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Examples of the acid component include aromatic dicarboxylic acids such as phthalic acid, isophthalic acid, and terephthalic acid, and anhydrides thereof; alkyldicarboxylic acids such as succinic acid, adipic acid, sebacic acid, and azelaic acid, and anhydrides thereof; succinic acids substituted with an alkyl group or alkenyl group having 6 to 12 carbon atoms, and anhydrides thereof; and unsaturated dicarboxylic acids such as fumaric acid, maleic acid, and citraconic acid, and anhydrides thereof.

Among them, in particular, a polyester resin or a polyester unit obtained by condensation polymerization using a bisphenol derivative represented by the following general formula (3) as a diol component and a carboxylic acid component of divalent or more carboxylic acid, anhydride thereof, or lower alkyl ester thereof (such as fumaric acid, maleic acid, maleic anhydride, phthalic acid, terephthalic acid, trimellitic acid, and pyromellitic acid) as an acid component is preferred because the resin or unit serving as a color toner exhibits excellent charging property.

Formula (3)

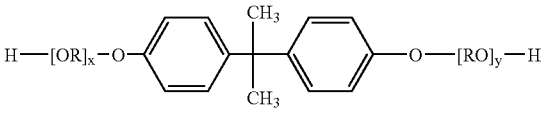

(wherein R represents an ethylene group or a propylene group, each of x and y is an integer of 1 or more, and the mean value of x+y is 2 to 10).

Examples of the vinyl monomers for forming the vinyl resin or the vinyl polymer unit used for the hybrid resin contained in the toner of the present invention include styrene; styrene derivatives such as o-methylstyrene, m-methylstyrene, p-methylstyrene, α-methylstyrene, p-phenylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene, and p-nitrostyrene; unsaturated monoolefins such as ethylene, propylene, butylene, and isobutylene; unsaturated polyenes such as butadiene and isoprene; vinyl halides such as vinyl chloride, vinylidene chloride, vinyl bromide, and vinyl fluoride; vinyl esters such as vinyl acetate, vinyl propionate, and vinyl benzoate; α-methylene aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylate esters such as methyl acrylate, ethyl acrylate, propyl acrylate, n-butyl acrylate, isobutyl acrylate, n-octyl acrylate, dodecyl acrylate, 2-ethylhexyl acrylate, stearyl acrylate, 2-chloroethylacrylate, and phenyl acrylate; vinyl ethers such as vinyl methyl ether, vinyl ethyl ether, and vinyl isobutyl ether; vinyl ketones such as vinyl methyl ketone, vinyl hexyl ketone, and methyl isopropenyl ketone; N-vinyl compounds such as N-vinylpyrrole, N-vinylcarbazole, N-vinylindole, and N-vinylpyrrolidone; vinylnaphthalenes; and acrylate or methacrylate derivatives such as acrylonitrile, methacrylonitrile, and acrylamide.

Further, examples of the vinyl monomer include unsaturated dibasic acids such as maleic acid, citraconic acid, itaconic acid, alkenylsuccinic acid, fumaric acid, and mesaconic acid; unsaturated dibasic acid anhydrides such as maleic anhydride, citraconic anhydride, itaconic anhydride, and alkenylsuccinic anhydride; unsaturated dibasic acid half esters such as methyl maleate half ester, ethyl maleate half ester, butyl maleate half ester, methyl citraconate half ester, ethyl citraconate half ester, butyl citraconate half ester, methyl itaconate half ester, methyl alkenylsuccinate half ester, methyl fumarate half ester, and methyl mesaconate half ester; unsaturated dibasic acid esters such as dimethyl maleate and dimethyl fumarate; α,β-unsaturated acids such as acrylic acid, methacrylic acid, crotonic acid, and cinnamic acid; anhydrides of α,β-unsaturated acids such as crotonic anhydride and cinnamic anhydride; anhydrides of the above-mentioned α,β-unsaturated acids and lower aliphatic acids; and monomers each having a carboxyl group such as alkenylmalonic acid, alkenylglutaric acid, and alkenyladipic acid, acid anhydrides thereof, and monoesters thereof.

Further, examples of the vinyl monomer include acrylate esters or methacrylate esters such as 2-hydroxyethyl acrylate, 2-hydroxyethyl methacrylate, and 2-hydroxypropyl methacrylate; and monomers having hydroxy groups such as 4-(1-hydroxy-1-methylbutyl)styrene and 4-(1-hydroxy-1-methylhexyl)styrene.

The above-mentioned vinyl resins or vinyl polymer units used for hybrid resins may have a crosslinking structure crosslinked with a crosslinking agent having two or more vinyl groups. Examples of the crosslinking agent to be used include aromatic divinyl compounds such as divinylbenzene and divinylnaphthalene; diacrylate compounds bonded together with an alkyl chain, such as ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and those obtained by changing the "acrylate" of each of the aforementioned compounds to "methacrylate"; diacrylate compounds bonded together with an alkyl chain containing an ether bond, such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and those obtained by changing the "acrylate" of each of the aforementioned compounds to "methacrylate"; and diacrylate compounds bonded together with a chain containing an aromatic group and an ether bond, such as polyoxyethylene(2)-2,2-bis(4-hydroxyphenyl) propane diacrylate, polyoxyethylene(4)-2,2-bis (4-hydroxyphenyl)propane diacrylate, and those obtained by changing the "acrylate" of each of the aforementioned compounds to "methacrylate".

The crosslinking agents may be polyfunctional, and examples of the polyfunctional crosslinking agents include pentaerythritol triacrylate, trimethylolethane triacrylate, trimethylolpropane triacrylate, tetramethylolmethane tetraacrylate, oligoester acrylate, and those obtained by changing the "acrylate" of the aforementioned compounds to "methacrylate", triallyl cyanurate, triallyl trimellitate.

For adjusting the molecular weight distribution of the vinyl resin or the vinyl polymer unit, it is preferable to use a molecular weight modifier. The examples of the molecular weight modifier include mercaptans generally represented by the formula: R—SH (wherein R is an alkyl group) such as t-dodecylmercaptan, or α-methyl styrene, α-methyl styrene dimer, and α-methyl styrene oligomers.

Examples of the polymerization initiators to be used in the production of the aforementioned vinyl resins or vinyl polymer units used for hybrid resins include 2,2-azobisisobutyronitrile,
2,2-azobis(4-methoxy-2,4-dimethylvaleronitrile),
2,2-azobis(2,4-dimethylvaleronitrile),
2,2-azobis(2-methylbutyronitrile),
dimethyl-2,2-azobisisobutyrate,
1,1-azobis(1-cyclohexanecarbonitrile), 2-carbamoylazoisobutyronitrile, 2,2-azobis(2,4,4-trimethylpentane), 2-phenylazo-2,4-dimethyl-4-methoxyvaleronitrile, 2,2-azobis(2-methylpropane), ketone peroxides such as methyl ethyl ketone peroxide, acetylacetone peroxide, and cyclohexanone peroxide, 2,2-bis(t-butylperoxy)butane, t-butyl hydroperoxide, cumene hydroperoxide, 1,1,3,3-tetramethylbutyl hydroperoxide, di-t-butyl peroxide, t-butylcumyl peroxide, dicumyl peroxide, α,α-bis(t-butylperoxyisopropyl)benzene isobutyl peroxide, octanoyl peroxide, decanoyl peroxide, lauroyl peroxide, 3,5,5-trimethylhexanoyl peroxide, benzoyl peroxide, m-trioyl peroxide, diisopropyl peroxydicarbonate, di(2-ethylhexyl)peroxydicarbonate, di(n-propyl) peroxydicarbonate, di(2-ethoxyethyl)peroxycarbonate, dimethoxyisopropyl peroxydicarbonate, di(3-methyl-3-methoxybutyl) peroxycarbonate, acetylcyclohexylsulfonyl peroxide, t-butyl peroxyacetate, t-butyl peroxyisobutyrate, t-butyl peroxyneodecanoate, t-butyl peroxy-2-ethylhexanoate, t-butyl peroxylaurate, t-butyl peroxybenzoate, t-butylperoxyisopropyl carbonate, di(t-butyl)peroxyisophthalate, t-butyl peroxyallylcarbonate, t-amyl peroxy-2-ethylhexanoate, di(t-butyl)peroxyhexahydroterephthalate, and di(t-butyl)peroxyazelate.

The binder resin to be contained in the toner of the present invention may be the hybrid resin having the polyester unit and the vinyl polymer unit. The presence of the hybrid resin can be confirmed by a $^{13}$C-NMR measurement. The presence of the hybrid resin can be confirmed by the generation of a new peak which does not attribute to each of the polyester unit and the vinyl polymer unit in the resultant $^{13}$C-NMR chart. Table 1 shows an example of the results of the measurement using acrylate ester and a styrene monomer as vinyl monomers.

TABLE 1

| | Newly detected signal | Signal of carboxyl group in aliphatic dicarboxylic acid | | Signal of carboxyl group |
|---|---|---|---|---|
| | Approximately 168 ppm | Approximately 172 ppm | Approximately 174 ppm | in acrylate ester Approximately 176 ppm |
| Polyester | — | ○ | ○ | — |
| Vinyl polymer | — | — | — | ○ |
| Hybrid resin | ○ | ○ | ○ | ○ |

At least one of the vinyl polymer unit and the polyester unit in the above hybrid resin preferably contains a monomer component capable of reacting with each unit component. Among monomers that constitute the polyester unit, a monomer capable of reacting with the vinyl polymer unit may be an unsaturated dicarboxylic acid such as fumaric acid, maleic acid, citraconic acid, or itaconic acid, or anhydride thereof. Among monomers that constitute the vinyl polymer unit, a monomer capable of reacting with the polyester unit may be one having a carboxyl group or a hydroxyl group, or acrylate ester or methacrylate ester.

The hybrid resin can be manufactured by, for example, the following methods (1) to (6).

In the method (1), a vinyl resin, a polyester resin, and a hybrid resin are individually prepared and then blended together. In this method, blending is performed by dissolving and swelling the above resins in organic solvent (e.g., xylene) and removing the organic solvent. The hybrid resin can be synthesized by independently manufacturing a vinyl polymer unit and a polyester unit, dissolving and swelling these units in a small amount of organic solvent, adding an esterification catalyst and alcohol in the mixture of these resins, and heating the mixture to allow an ester exchange reaction.

In the method (2), a vinyl polymer unit is manufactured at first, and then in the presence of the vinyl polymer unit, a polyester unit and a hybrid resin are manufactured. The hybrid resin is manufactured by reacting a vinyl polymer unit (if required, vinyl monomers may be added) with either or both of polyester monomers (alcohol, carboxylic acid) and a polyester unit. In this case, any appropriate organic solvent may be used.

In the method (3), a polyester unit is manufactured at first, and then, in the presence of the polyester unit, a vinyl polymer unit and a hybrid resin are manufactured. The hybrid resin is manufactured by reacting a polyester unit (if required, polyester monomers may be added) and either or both of vinyl monomers and a vinyl polymer unit. In this case, any appropriate organic solvent may be used.

In the method (4), a vinyl polymer unit and a polyester unit are manufactured at first, and then, in the presence of these units, either or both of vinyl monomers and polyester monomers (alcohol or carbonic acid) are added, resulting in the hybrid resin. In this case, any appropriate organic solvent may be used.

In the method (5), a hybrid resin is manufactured at first, and then, in the presence of the hybrid resin, either or both of vinyl monomers and polyester monomers (alcohol or carbonic acid) is added to allow an appropriate reaction selected from an addition polymerization reaction and a condensation polymerization reaction, resulting in the manufacture of the hybrid resin that contains at least one of a vinyl polymer unit and a polyester unit. In this case, the hybrid resin used may be manufactured by one of the above methods (2) to (4), and in addition, may be manufactured by a known method if required. Further, any appropriate organic solvent may be used.

In the method (6), vinyl monomers and polyester monomers (e.g., alcohol or carboxylic acid) are mixed, followed by sequentially performing addition polymerization and condensation polymerization reactions to produce a vinyl polymer unit, a polyester unit, and a hybrid resin. Furthermore, any appropriate organic solvent may be used.

In the above manufacturing methods (1) to (6), each of the vinyl polymer unit and the polyester unit may contain a plurality of polymer units having different molecular weights and degrees of cross-linking.

Next, a yellow pigment to be used in the yellow toner of the present invention will be described.

In the toner of the present invention, a yellow pigment containing a monoazo compound represented by the formula (1) is preferably prepared by a coupling reaction in an aqueous solution. The coupling reaction may be performed by one of the well-known methods including: a method in which a solution containing a diazo or tetrazo component is dropped into a solution containing a coupler component; a method in which a solution containing a coupler component is dropped into a solution containing a diazo or tetrazo component; and a method in which a solution containing a diazo or tetrazo component and a solution containing a coupler component are simultaneously dropped into another aqueous solution provided as a reaction solution.

When the yellow pigment containing a monoazo compound represented by the formula (1), which can be dispersed in the toner of the present invention, has particles with a volume average particle diameter of more than 100 nm, and the ratio of particles having a particle diameter of 300 nm or more is 0.1 to 20% by volume on the basis of total particles of yellow pigment in the toner particles, a good transparency of a toner and a satisfactory color tint as a yellow toner are obtained. More preferably, the particles of yellow pigment have a volume average particle diameter of more than 100 nm, and the ratio of particles having a particle diameter of 300 nm or more is 0.2 to 15% by volume on the basis of total particles of yellow pigment. Still more preferably, the particles of yellow pigment have a volume average particle diameter of more than 100 nm, and the ratio of particles having a particle diameter of 300 nm or more is 0.5 to 10% by volume on the basis of total particles of yellow pigment.

For attaining a preferable dispersion state of the pigment in the toner, it is preferable to include a water-soluble resin or a resin emulsion in the aqueous solution used for preparing the yellow pigment containing the monoazo compound. The water-soluble resin and the resin emulsion may be used solely or in combination with each other.

As a method of allowing the presence of the water-soluble resin or the resin emulsion in the aqueous solution for preparing the yellow pigment, after synthesizing a monoazo compound, the water-soluble resin or the resin emulsion may be added in a solution that contains the monoazo compound. Particularly preferable is to prepare the pigment by conducting a coupling reaction in an aqueous solution that contains 5 to 500 parts by mass of one of the water-soluble resin and the resin emulsion with respect to 100 parts by dry mass of the yellow pigment. For allowing the presence of the water-soluble resin or the resin emulsion in the aqueous solution at the time of the coupling reaction, it is preferable to add the water-soluble resin or the resin emulsion to a solution containing a coupler component or a solution containing a diazo or tetrazo component in advance. Alternatively, it may be added to the solution at the initiating of the coupling reaction or during the reaction. Among the conceivable methods, preferred is the method of adding the water-soluble resin or the resin emulsion to a solution containing a solution containing a coupler component and, a solution containing a diazo or tetrazo component in advance or at the time of initiating the coupling reaction. The presence of the water-soluble resin or the resin emulsion during the preparation of a yellow pigment containing a monoazo compound provides the yellow pigment with an effect that the resin covering the pigment particle and preventing the pigment particles from aggregating, so that the pigment may be in a preferable dispersion state in the toner. Further, when a water-soluble resin or a resin emulsion is present during the synthesis of a monoazo compound, the effect of preventing exceeding growth of pigment particles can be also attained. Therefore, the pigment may be in a particularly preferable dispersion state in the toner.

The amount of a resin to be included in an aqueous solution in which a coupling reaction is conducted is preferably from 5 to 500 parts by mass, more preferably from 10 to 300 parts by mass, particularly preferable from 10 to 200 parts by mass with respect to 100 parts by dry mass of a yellow pigment produced by the reaction. When the amount of the resin with respect to the dry mass of the pigment is 5 parts by mass or more, a sufficient effect of preventing an aggregation of pigment particles can be obtained. In addition, when the amount of the resin is 500 parts by mass or less, a suitable viscosity of the aqueous solution is obtained, and the pigment can be synthesized in an efficient manner. Furthermore, when using the resin emulsion, the addition amount of the resin emulsion is the amount of solids content.

In the present invention, with respect to a chromatogram obtained by a GPC measurement, the above water-soluble resin is one where a THF soluble fraction has a peak preferably in the region of 2,000 to 50,000 in molecular weight, more preferably in the region of 5,000 to 20,000 in molecular weight. When the THF soluble fraction has a peak in the region of 2,000 to 50,000 in molecular weight, the water-soluble resin becomes easily adsorbed on the surface of pigment particles in an effective manner. Therefore, an aggregation of pigment particles can be effectively inhibited and the pigment can be kept in a dispersion state preferable for the toner of the present invention. The above peak molecular weight can be adjusted, for example, by selecting an appropriate kind or amount of a binder resin to be used.

In the toner of the present invention, with respect to a chromatogram obtained by a GPC measurement, the above resin emulsion is one where a THF soluble fraction has a peak preferably in the region of 3,000 to 1,000,000 in molecular weight, more preferably in the region of 5,000 to 100,000 in molecular weight. When the THF soluble fraction has a peak in the region of 3,000 to 1,000,000 in molecular weight, the resin emulsion becomes easily adsorbed on the surface of pigment particles in an effective manner. Therefore, an aggregation of pigment particles can be effectively inhibited and the pigment can be kept in a dispersion state preferable for the toner of the present invention. The above peak molecular weight can be adjusted, for example, by selecting an appropriate kind or amount of a binder resin to be used.

In the toner of the present invention, the above resin emulsion has preferably a volume average particle diameter of 50 to 500 nm, more preferably 100 to 300 nm. When the resin emulsion has a volume average particle diameter of 50 to 500 nm, the resin emulsion becomes easily adsorbed on the surface of pigment particles in an effective manner. Therefore, the pigment can be kept in a preferable dispersion state for the toner of the present invention.

In the toner of the present invention, each of the water-soluble resin and the resin emulsion is preferably one having a glass transition temperature in the range of 30 to 105° C., more preferably a glass transition temperature in the range of 50 to 80° C., in a DSC curve during a temperature rising measured by DSC. When the resin emulsion has a glass transition temperature in the range of 30 to 100° C., it is easy to disperse the pigment in the main binder resin at the time of melt-kneading. Therefore, the pigment can be kept in a preferable dispersion state for the toner of the present invention.

The water-soluble resin, which is contained in a coupling-reaction solution for a monoazo yellow pigment included in the toner of the present invention, may be a resin which solely dissolves in water. Alternatively, it may dissolve in water by the addition of a small amount of a base or an acid.

When a polyester resin or a hybrid resin is used as a water-soluble resin, as a raw material monomer of a polyester unit of the polyester resin or the hybrid resin, similar monomer for the binder resin used in the toner of the present invention may be also used. Another monomer that can be used is dicarboxylic acid having a sulfonic acid group. In particular, when 5-sulfoisophthalic acid sodium salt represented by the following formula (4) is used as an acidic component, the water-solubility of the resin is high and the resin is almost uniformly dispersed in an aqueous solution.

Formula (4)

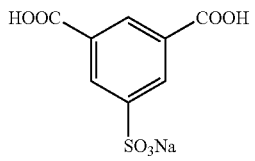

As a raw material monomer used in a vinyl resin of the water-soluble resin, similar monomer in the binder resin for the toner of the present invention may be used. Other monomers used as raw material monomers may include monomers having sulfonic acid groups such as 2-acrylamide-2-methylbenzene sulfonic acid and styrene sulfonic acid.

Among the above monomers, it is preferable to use at least one of a monomer having a carboxylic group, a monomer having a sulfonic acid group, and a monomer having a sulfonate group. In particular, it is more preferable to use the monomer having the sulfonic acid group or sulfonate group. Therefore, a preferable resin to be used is one polymerized using these monomers, which is added with a small amount of alkaline to neutralize the acid group. In this case, the water-solubility of the resin is high, so that it can be dispersed in an aqueous solution uniformly. Alternatively, a monomer with a hydroxyl group may be used for preparing the resin. In this case, the resultant resin has a high water-solubility, so that it is also preferable.

When a polyester resin is used as a water-soluble resin, the acid value of the resin is preferably 100 mgKOH/g or less. If the acid value exceeds 100 mgKOH/g, the charging property of the toner may be decreased.

When a vinyl resin or a hybrid resin is used as a water-soluble resin, the acid value of the resin is preferably in the range of 30 to 200 mgKOH/g, more preferably in the range of 50 to 120 mgKOH/g. If the acid value is 30 mgKOH/g or more, a sufficient dispersion effect of the pigment can be obtained. Also, the charging property of the toner can be easily controlled when the acid value of the resin is 200 mgKOH/g or less.

A resin emulsion included in a coupling reaction solution of a monoazo yellow pigment contained in the toner of the present invention can be prepared by one of the methods well-known in the art. For example, the resin emulsion may be prepared by an emulsion polymerization or an emulsification performed by dissolving a polymer in a water-soluble or water-insoluble organic solvent and then adding the polymer-containing solvent in water.

When a polymer resin or a hybrid resin is used as a resin emulsion, a raw material monomer used in the polyester unit of the polyester resin or the hybrid resin may be similar to that of the water-soluble resin described above.

In addition, a raw material monomer used in the vinyl polymer unit of a vinyl resin or a hybrid resin used as a resin emulsion may be similar to that of the water-soluble resin described above.

The acid value of the resin emulsion is preferably in the range of 5 to 100 mgKOH/g, more preferably in the range of 10 to 20 mgKOH/g. If the acid value is 5 mgKOH/g or more, a sufficient dispersion effect of the pigment can be obtained. If the acid value is 100 mgKOH/g or less, the charging property of the toner can be easily controlled.

In the present invention, the monoazo compounds represented by the general formula (1) include compounds represented by the following formulas (2), and (5) to (23). When the compound represented by the following formula (2) is used among those compounds, the compound preferably allows the toner to attain a preferable color as a yellow toner. Those derivative compounds may be used in combination.

Formula (2)

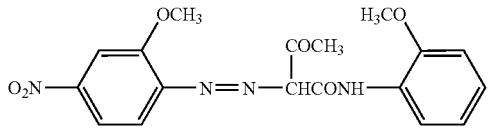

Formula (5)

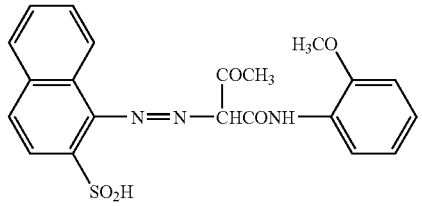

Formula (6)

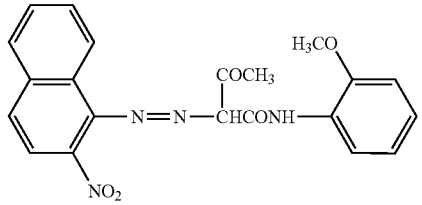

Formula (7)

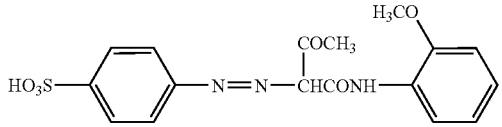

Formula (8)

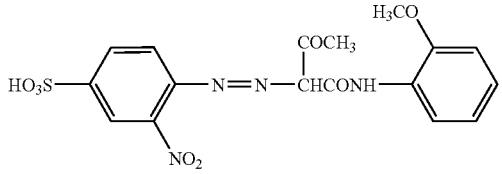

Formula (9)

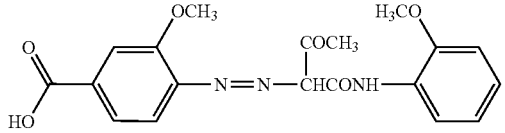

Formula (10)

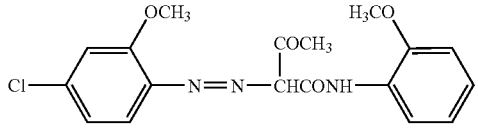

Formula (11)

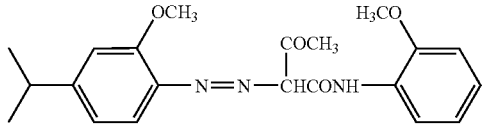

-continued

Formula (12)

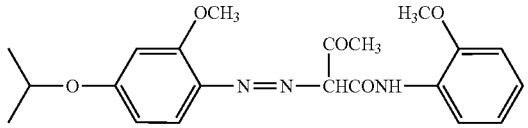

Formula (13)

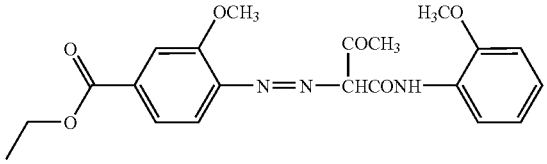

Formula (14)

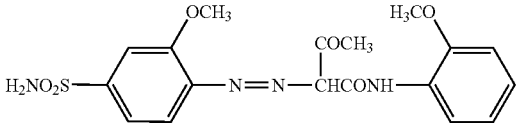

Formula (15)

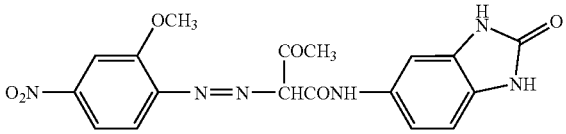

Formula (16)

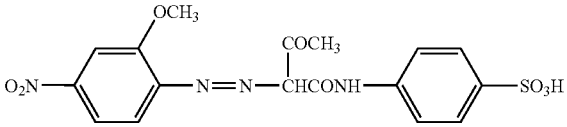

Formula (17)

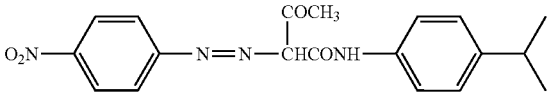

Formula (18)

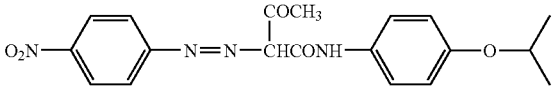

Formula (19)

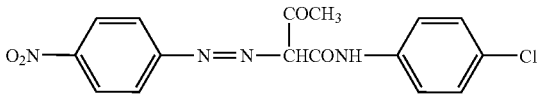

Formula (20)

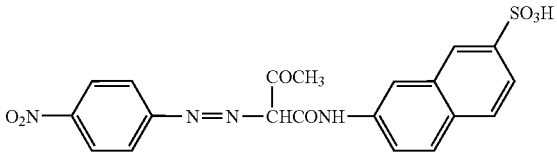

Formula (21)

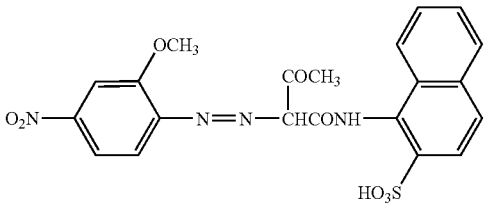

-continued

Formula (22)

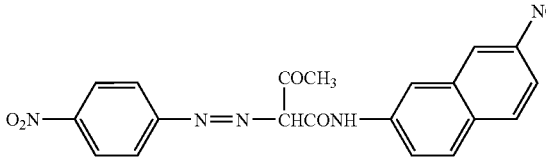

Formula (23)

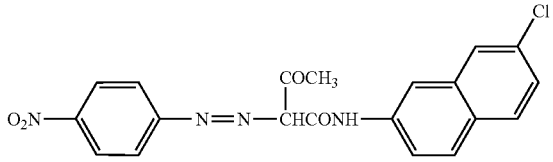

Even though the toner of the present invention contains the yellow pigment containing the monoazo compound represented by the general formula (1), the yellow pigment may further contain another monoazo compound. It is preferable that a monoazo compound represented by the formula (2) is provided as a main component of the yellow pigment, while the monoazo compound represented by the formula (1), structurally different from one represented by the formula (2), is provided as an accessory component. It is particularly preferable to contain the compounds of the formulas (2) and (1) at a mole ratio of 99:1 to 70:30. In this case, the primary particle size of the pigment is kept small, so that the transparency of the toner can be improved, and variations in color tint caused by introducing a derivative compound can be reduced. As a result, a satisfactory color tint will be obtained together with a satisfactory reflected image and a satisfactory transmitted image.

The toner of the present invention may further contain other yellow pigments or yellow dyes. Examples of the other yellow pigments include C.I. Pigment Yellow 12, 13, 14, 17, 62, 83, 93, 94, 95, 109, 110, 120, 128, 129, 147, 151, 154, 155, 166, 167, 180, 185, 191, and 199. Examples of the other yellow dyes include C.I. Disperse Yellow 42, 51, 118, and 160; and C.I. Solvent Yellow 93, 114, and 162.

Further, in the image forming method using the yellow toner of the present invention, the yellow toner of the present invention can be used in combination with another color toner. In this case, the pigment or dye other than yellow is not particularly limited. Examples of colorants for other colors will be indicated as follows.

As the magenta colorant, a pigment may be used solely or a pigment and a dye may be used in combination. Examples of the magenta pigment include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, 209, and 238; C.I. Pigment Violet 19; and C.I. Vat Red 1, 2, 10, 13, 15, 23, 29, and 35. Examples of the magenta dye include oil-soluble dyes such as C.I. Solvent Red 1, 3, 8, 23, 24, 25, 27, 30, 49, 81, 82, 83, 84, 100, 109, and 121; C.I. Disperse Red 9; C.I. Solvent Violet 8, 13, 14, 21, and 27; and C.I. Disperse Violet 1; and basic dyes such as C.I. Basic Red 1, 2, 9, 12, 13, 14, 15, 17, 18, 22, 23, 24, 27, 29, 32, 34, 35, 36, 37, 38, 39, and 40; and C.I. Basic Violet 1, 3, 7, 10, 14, 15, 21, 25, 26, 27, and 28.

Examples of the cyan coloring pigment include C.I. Pigment Blue 2, 3, 15, 16, and 17; C.I. Acid Blue 6; and copper phthalocyanine pigments having a structure of C. I. Acid Blue 45 or phthalocyanine substituted with 1 to 5 methyl phthalimide groups.

Examples of a black colorant used in the present invention includes carbon black, a magnetic substance, the above-mentioned yellow/magenta/cyan colorants that are mixed into black, and the like.

The content of the colorant in the toner is preferably from 1 to 15 parts by pass with respect to 100 parts by mass of the binder resin, more preferably from 3 to 12 parts by mass, still more preferably from 4 to 10 parts by mass. When the content of the colorant is more than 15 parts by mass, the transparency of the toner is deteriorated. In addition, the reproducibility of an intermediate color, represented by a human skin color, tends to be deteriorated. Further, with respect to the charging property of the toner, the stability will be deteriorated. Therefore, it becomes difficult to obtain a desired charge amount. If the content of the colorant is less than 1 part by mass, a coloring power is decreased. As a result, it is difficult to obtain a high quality image with a high image concentration.

Examples of the wax contained in the toner of the present invention include an aliphatic hydrocarbon wax such as a low molecular weight polyethylene, a low molecular weight polypropylene, a microcrystalline wax, or a paraffin wax; an aliphatic hydrocarbon wax oxide such as a polyethylene wax oxide; a block copolymer of an aliphatic hydrocarbon wax; a wax containing a fatty ester such as a carnauba wax, a sasol wax, or a montanate wax as a main component; and a wax containing a fatty ester deacidified partially or totally such as a deacidified carnauba wax.

Further, examples of the above-mentioned wax include straight-chain saturated fatty acids such as palmitic acid, stearic acid, and montan acid; unsaturated fatty acids such as brassidic acid, eleostearic acid, and barinarin acid; saturated alcohols such as stearyl alcohol, aralkyl alcohol, behenyl alcohol, carnaubyl alcohol, ceryl alcohol, and melissyl alcohol; polyalcohols such as sorbitol; fatty amides such as linoleic amide, oleic amide, and lauric amide; saturated fatty bis amides such as methylene bis stearamide, ethylene bis capramide, ethylene bis lauramide, and hexamethylene bis stearamide; unsaturated fatty amides such as ethylene bis oleamide, hexamethylene bis oleamide, N,N'-dioleyl adipamide, and N,N'-dioleyl sebacamide; aromatic bis amides such as m-xylene bis stearamide and N-N'-distearyl isophthalamide, fatty acid metallic salts (generally called metallic soaps) such as calcium stearate, calcium laurate, zinc stearate, and magnesium stearate; graft waxes of which aliphatic hydrocarbon waxes are grafted with vinyl monomers such as styrene and acrylate; partially esterified compounds of fatty acids and polyalcohols such as behenic monoglyceride; and methyl ester compounds with hydroxyl groups obtained by hydrogenation of vegetable oil.

Particularly preferable wax to be used is an aliphatic hydrocarbon wax such as a paraffin wax.

The amount of the wax to be contained in the toner is preferably from 0.1 to 10% by mass on the basis of the mass of the toner. When the amount of the wax is 0.1% by mass or more, and the application amount of a fixing oil is reduced or the fixing oil is not used at all, a good releasing effect can be obtained. When the amount of the wax is 10% by mass or less, the transparency of the toner can be retained and an image having an excellent color saturation can be formed.

The maximum endothermic peak temperature becomes lower than the glass transition temperature of the binder resin used for the present invention when a wax having a maximum endothermic peak of less than 65° C. in a DSC curve measured by the above DSC at rising temperatures is used. Thus, a wax begins to melt onto the surface of the toner when the toner is left in high-temperature surroundings, so that anti-blocking performance may deteriorate substantially. When the maximum endothermic peak is larger than 120° C., the toner cannot migrate on the surface of the toner because the wax can melt promptly upon fixing and melting the toner. Therefore, the releasing property of the toner becomes inferior and a high-temperature offset may easily occur.

In the present invention, an organometallic compound may be used as a charge-controlling agent. The organometallic compounds used in the present invention include: aromatic carboxylic acid derivative selected from aromatic oxycarboxylic acid and aromatic alkoxycarboxylic acid; and a metal compound of the aromatic carboxylic acid derivative. Metals of these compounds are preferably a 2- or more-valent metal atom. The divalent metals include $Mg^{2+}$, $Ca^{2+}$, $Sr^{2+}$, $Pb^{2+}$, $Fe^{2+}$, $Co^{2+}$, $Ni^{2+}$, $Zn^{2+}$ and $Cu^{2+}$. Among them, as a divalent metal, $Zn^{2+}$, $Ca^{2+}$, $Mg^{2+}$, and $Sr^{2+}$ are preferable. In addition, 3- or more-valent metals include $Al^{3+}$, $Cr^{3+}$, $Fe^{3+}$, and $Ni^{3+}$. Among them, $Al^{3+}$ is preferable.

In the present invention, as an organometallic compound, an aluminum compound of di-tert-butyl salicylic acid is particularly preferable.

A metal compound of the aromatic carboxylic acid derivative selected from the aromatic oxycarboxylic acid and aromatic alkoxycarboxylic acid may be obtained, for example, by dissolving oxycarboxylic acid and alkoxycarboxylic acid in a sodium hydroxide aqueous solution, dropping an aqueous solution in which 2- or more-valent metal atoms are dissolved into the sodium hydroxide aqueous solution, stirring the resultant mixture under heat, adjusting the pH of the aqueous solution, and cooling the solution to room temperature, followed by filtrating and washing. The method of obtaining the metal compound of the aromatic carboxylic acid derivative is not limited to one described above.

In the toner of the present invention, the organometallic compound may be added to the toner at an amount of 5 parts by mass or less on the basis of 100 parts by mass of the binder resin in the toner. However, the content of such a compound in the toner is preferably from 0.1 to 1 parts by mass, more preferably from 0.2 to 0.8 parts by mass. If the addition amount of the organometallic compound exceeds 5 parts by mass, it becomes difficult to control the deformation of the toner, which is not preferable.

For improving an image quality, in the toner of the present invention, it is preferable that a fluidity improving agent is externally added to the toner particles. The term "fluidity improving agent" used herein means a compound which is externally added to toner particles to increase the fluidity thereof compared to before the addition.

Examples of the fluidity improving agent include fluorine resin powder such as vinylidene fluoride fine powder and polytetrafluoroethylene fine powder; silica fine powder such as wet-processed silica fine powder and dry-processed silica fine powder, processed silica fine powder of above silica fine powders of which surface is treated with a treatment agent such as a silane coupling agent, a titanium coupling agent, and a silicone oil; titanium oxide fine powder, alumina fine powder, processed titanium oxide fine powder, and processed alumina fine powder.

A preferable effect can be obtained when the fluidity improving agent has a specific surface area of 30 $m^2/g$ or more, more preferably 50 $m^2/g$ or more by nitrogen adsorption measured by the BET method. The fluidity improving agent may be added preferably at a concentration of 0.01 to 8 parts by mass, preferably 0.1 to 4 parts by mass, with respect to 100 parts by mass of the toner particles.

The external addition of the fluidity improving agent is performed by sufficiently mixing the fluidity improving agent with toner particles using a mixer such as a Henschel mixer. By such a mixing operation, the toner having the fluidity improving agent on the particle surface can be obtained.

In the case of using the toner of the present invention in a two-component developer, the toner is used after mixing with a magnetic carrier. Examples of such a magnetic carrier include metal particles such as iron or surface-oxidized iron, nickel, copper, zinc, cobalt, manganese, chromium, and rare earth metals, alloy particles thereof, magnetic particles such as oxide particles and ferrite thereof, coated carriers prepared by coating the surface of the magnetic particle with a resin, and magnetic-particle dispersed resin carriers in which these magnetic particles are dispersed in resin particles.

The coated carrier with the surface of the magnetic particle coated with the resin is particularly preferable in a developing method in which an alternating-current bias is applied to a developing sleeve. The applicable coating methods well-known in the art include: a method of dissolving or suspending a coating material such as a resin in a solvent to prepare a coating solution, and adhering the application solution to the surface of a magnetic carrier core particle; and a method of mixing magnetic carrier core particles and a coating material in a powdery form to adhere them to each other.

The coating materials used for coating the surface of the magnetic carrier core particle include a silicone resin, a polyester resin, a styrene resin, an acrylic resin, polyamide, polyvinyl butyral, and an aminoacrylate resin. These materials are used solely or in combination with each other.

The amount of the coating material to be processed is preferably from 0.1 to 30% by mass, more preferably from 0.5 to 20% by mass, with respect to the carrier core particle. The average particle diameter of the carrier is preferably from 10 to 100 μm, more preferably from 20 to 70 μm.

When the toner of the present invention is mixed with the magnetic carrier to prepare a two-component developing agent, the mixing ratio of these components is defined such that the content of the toner in the developing agent is preferably from 2 to 15% by mass, more preferably from 4 to 13% by mass, for usually obtaining favorable results.

Next, a method of manufacturing a toner according to the present invention will be described.

As described above, the yellow pigment according to the present invention is preferably produced in water in the presence of an aqueous resin or a resin emulsion. In this case, the yellow pigment can be obtained as a mixture with the resin. The mixture is filtrated and washed repeatedly to remove impurities, followed by subjecting the mixture to a filter press to obtain a press cake of a pigment resin composition containing the pigment, the resin, and water. For the toner of the present invention, the press cake of the pigment resin composition may be used or a dried press cake may be used. In addition, the pigment resin composition may be used as a toner raw material as it is, or may be primarily mixed with a part of the resin to be used for a master batch. When the content of the pigment portion in the master batch is from 20 to 50% by mass, an appropriate dispersibility of the pigment can be obtained.

The resin to be used in the master batch may be any of those well-known in the art. Among them, a polyester resin, a vinyl resin, or a hybrid resin are preferably used in the master batch, and also combinations thereof may be allowed. In particular, it is preferable to use a polyester resin or a hybrid resin using an alkyl or alkenyl succinic acid derivative represented by the following formula as a raw material monomer because the pigment and the resin can be well mixed together, and also the pigment can be kept in a dispersed state during kneading under heat.

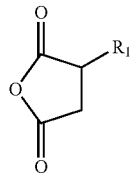

(wherein $R_1$ represents a straight- or branched-chain C5–20 alkyl group or C5–20 alkenyl group).

As a kneading machine to be used in the process of manufacturing a master batch of the yellow pigment of the present invention, one of the conventional devices including a kneader, a pressure kneader, a twin roll mill, and a triple roll mill may be used. At the time of kneading the master batch, the temperature of a kneaded product is preferably 130° C. or less. If the temperature of the kneaded product exceeds 130° C., the growth of primary particle of the pigment occurs and the transparency of the resulting toner tends to be deteriorated. Therefore, the temperature outside the above range is not preferable.

In the toner of the present invention, when the pigment or the pigment resin composition is provided as a master batch and used as a toner raw material, the master batch is pulverized and provided as powders with a particle diameter of 100 μm or less. The master batch having a particle diameter of more than 100 μm is not preferable because the mixing property of the master batch tends to be inferior upon kneading with the toner binder resin.

The toner of the present invention having the value of a* in the range of −5 to +14 when b* is +80 with respect to the transmission chromaticity of an image formed on a transparency sheet can be obtained by the use of a specific binder resin described above, the preparation of a pigment by a coupling reaction, and so on.

The image forming method in the present invention is one capable of forming a color image using the toner of the present invention described above. The image forming method in the present invention can be realized using a device or means well-known in the art and also using any conventional toner other than yellow. Hereinafter, an example of the image forming method in the present invention will be described with reference to FIG. 1.

FIG. 1 is a schematic block diagram of an example of an image forming apparatus for forming a full-color image by an electrophotographic process. The image forming apparatus of FIG. 1 is used as a full-color copier or a full-color printer. As shown in FIG. 1, the full-color copier generally includes a digital color image reader unit in its upper portion and a digital color image printer unit in its lower portion.

In the image reader unit of the image forming apparatus of FIG. 1, an original manuscript 30 is placed on an original table glass 31 and is then subjected to exposure scanning with an exposure lamp 32. A reflected light image from the original manuscript 30 is condensed into a full-color sensor 34 through a lens 33, and thus a color separation image signal is acquired from the reflected light image. The color separation image signal is passed through an amplifying circuit (not shown) and processed in a video processing unit (not shown) to be transmitted to a digital image printer unit.

In the image printer unit of the image forming apparatus of FIG. 1, a photoconductive drum (an image bearing member) 1 includes a photosensitive layer such as one having an organic photoconductor. The photoconductive drum 1 is supported such that the drum 1 is allowed to rotate in an arrow direction indicated in FIG. 1. Arranged around the photoconductive drum 1 are a pre-exposure lamp 11, a corona charger 2, a laser exposure optical system, an electric potential sensor 12, four developing devices 4Y, 4C, 4M, and 4B for different colors, on-drum light intensity detecting means 13, a transfer device, and a cleaning device 6.

In the laser exposure optical system, an image signal from a reader unit is converted to an optical signal for image-scanning exposure in a laser output unit (not shown). The converted laser beam is reflected on a polygon mirror 3*a* and is then projected on the surface of the photoconductive drum 1 through a lens 3*b* and a mirror 3*c*.

At the time of image forming, the printer unit lets the photoconductive drum 1 rotate in the arrow direction. After eliminating charges from the photoconductive drum 1 by the pre-exposure lamp 11, the photoconductive drum 1 is charged uniformly to have a negative polarity by the corona charger 2. Then, an optical image E is irradiated for every separated color and an electrostatic image is formed on the photoconductive drum 1.

Next, a predetermined developing device is operated to develop the electrostatic image on the photoconductive drum 1, forming a toner image on the photoconductive drum 1 using toners. The developing devices 4Y, 4C, 4M, and 4B selectively approach the photoconductive drum 1 depending on the respective separated colors by the operation of eccentric cams 24Y, 24C, 24M, and 24B, respectively.

The transfer device includes a transfer drum 5*a*, a transfer charger 5*b*, an attracting charger 5*c* for electrostatically attracting a transfer material as a recording material, an attracting roller 5*g* opposed to the attracting charger 5*c*, an inner charger 5*d*, an outer charger 5*e*, a stripping charger 5*h*, and a transfer sheet 5*f* that is rotatably supported to the transfer drum 5*a* with bearing portions and has an opening region in its peripheral surface to serve as a transfer material carrier for carrying the transfer material in the opening region. The transfer sheet 5*f* used in this apparatus is a resin film such as a polycarbonate film.

The transfer material is transported from a cassette 7*a*, 7*b*, or 7*c* to the transfer drum 5*a* through a transfer sheet transport system. Then, the transfer material is carried on the transfer sheet 5*f*. As the transfer drum 5*a* revolves, the transfer material supported on the transfer sheet 5*f* is repetitively transported to a transfer position facing the photoconductive drum 1. While the transfer material passes through the transfer position, a toner image is transferred from the photoconductive drum 1 to the transfer material by the action of a transfer charger 5*b*.

The above image forming process is performed for each of yellow (Y), magenta (M), cyan (C), and black (B), so that a color image in which toner images of four colors are overlapped can be formed on the transfer material carried on the transfer sheet 5*f*.

The transfer material, on which the toner images of four colors are transferred as described above, is stripped from the transfer sheet 5*f* by the actions of a stripping claw 8*a*, a stripping lifting roller 8*b*, and the stripping charger 5*h*, and is then transported to a heat-pressure-fixing device 9 where the toner images are thermally fixed under pressure, allowing the toners to be mixed, developed, and fixed on the transfer material.

Figure 2:
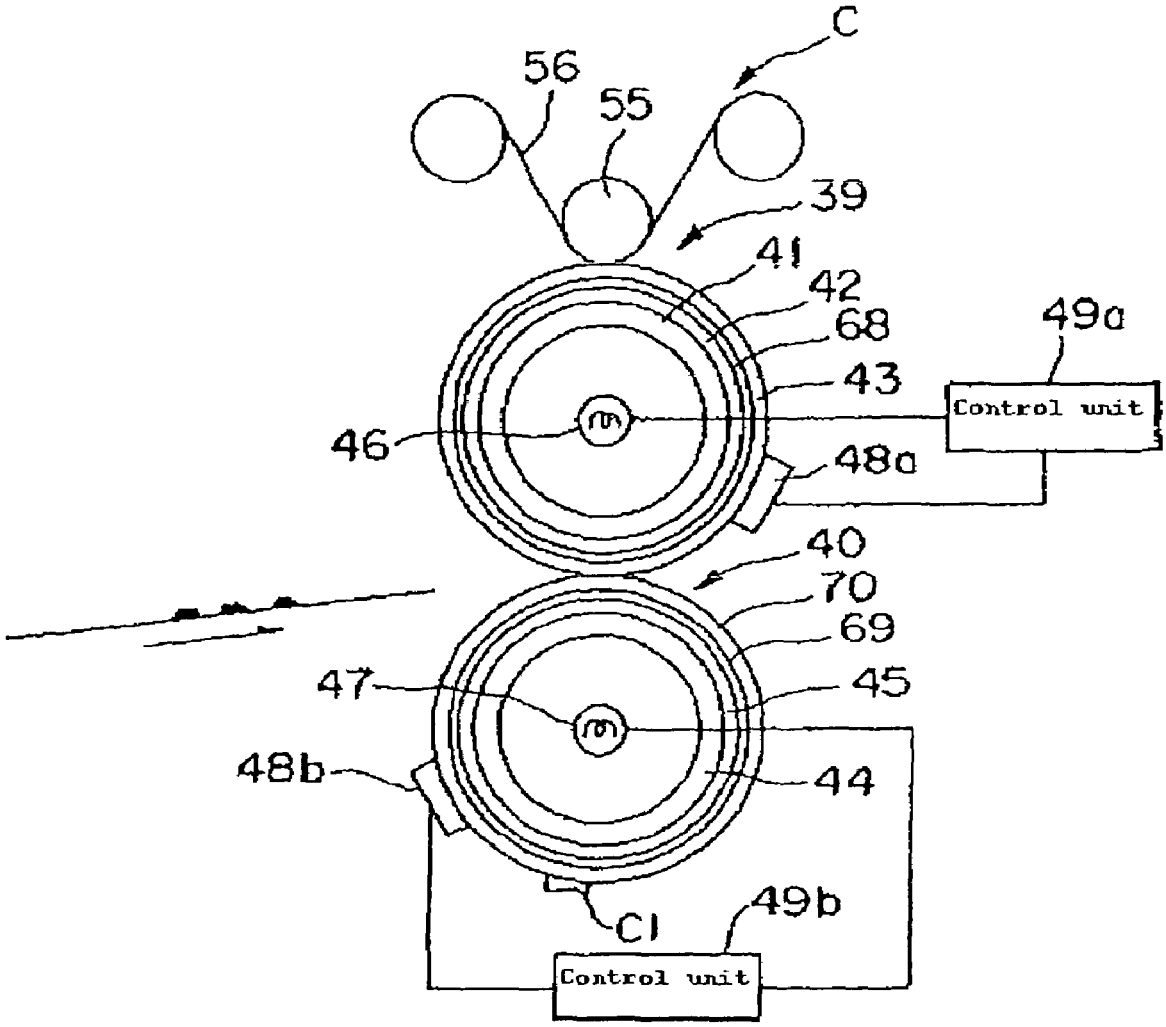
FIG. 2 is a schematic explanatory diagram showing an example of heat-pressure-fixing means used in the present invention.

As shown in FIG. 2, for example, the heat-pressure-fixing device 9 includes a fixing roller 39 provided as fixing means, a pressure roller 40, and a cleaning device C. The fixing roller 39 includes, for example, an aluminum core metal 41 of 5 mm in thickness, a RTV (RTV: room temperature vulcanization type, JIS-A hardness=20) silicone rubber layer 42 of 2 mm in thickness formed on the core metal 41, and a polytetrafluoroethylene (PTFE) layer 43 of 50 μm in thickness formed on the outside of the silicone rubber layer 42. In addition, an intermediate layer 68 may be formed between the silicone rubber layer 42 and the PTFE layer 43.

The pressure roller 40, which is pressurizing means, includes, for example, an aluminum core metal 44 of 5 mm in thickness, a RTV silicone rubber layer 45 (rubber hardness JIS-A hardness=40) of 2 mm in thickness formed on the core metal 44, and a PTFE layer 70 of 150 μm in thickness formed on the outside of the silicone rubber layer 45. In addition, an intermediate layer 69 may be formed between the silicone rubber layer 45 and the PTFE layer 70.

A halogen heater 46 as heat generating means is disposed on the fixing roller 39, while a halogen heater 47 is disposed in the core metal of the pressure roller 40. The fixing roller 39 and the pressure roller 40 are pressurized at a total pressure of 390 N (40 kgf) by a pressurizing mechanism (not shown).

The cleaning device C includes a non-woven web 56 and a pressure roller 55 for pressing the non-woven fabric of the non-woven web 56 against the surface of the fixing roller 39.

In FIG. 2, each of the fixing roller 39 and the pressure roller 40 has an outer diameter of 60 mm. The hardness of the pressure roller 40 is higher than that of the fixing roller 39. Therefore, in a delivery test with white paper, the delivery direction directs toward the pressure roller from a line perpendicular to a line connecting the central lines of both rollers. It is extremely important to arrange the delivery direction toward the pressure roller for preventing the transfer material from coiling around the fixing roller 39 when a copy image having a large image area is fixed. In order to arrange the delivery direction toward the pressure roller, there are several methods in addition to the method of setting a different hardness to each roller. That is, the methods include a method of making the diameter of the pressure roller smaller than that of the fixing roller, and a method of utilizing a very small shrinkage of paper by setting the preset temperature of the pressure roller higher than that of the fixing roller to vaporize more moisture from the rear surface of the fixing paper, i.e., the surface of paper on the pressure roller side.

The transfer material transported to the heat-pressure-fixing device 9 is heated from both sides by the fixing roller 39 and the pressure roller 40 when the transfer material passes through a fixing nip portion formed between the fixing roller 39 and the pressure roller 40. As a result, the toner is fused on the transfer material. The fixing of the toner using the heat-pressure-fixing device 9 is performed by detecting the temperatures of the fixing roller 39 and the pressure roller 40 by thermistors 48*a* and 48*b* abutted against the fixing roller 39 and the pressure roller 40, and controlling the halogen heaters 46 and 47 by controlling devices 49*a* and 49*b* on the basis on the detected temperatures to adjust the temperatures of the fixing roller 39 and the pressure roller 40 to certain temperatures (e.g., 150±10° C.), respectively. In the present invention, it is preferable that the heat-pressure-fixing is performed under the thermal conditions in which the surface temperature of the fixing roller 39 is in a range of 150 to 200° C.

The fixing operation speed (e.g., 160 mm/sec) of the heat-pressure-fixing device 9 is preferably slower than the process speed (e.g., 90 mm/sec) of the image forming apparatus main body. This is because a sufficient amount of heating should be provided to the toner when an unfixed image in which two to four layers of toners are overlapped is melted and mixed, and also the toner should be heated more intensely to perform the fixing at a speed lower than the developing speed.

The cleaning device C presses the non-woven web 56 against the fixing roller 39 by the pressure roller 55 to clean the fixing roller 39. The non-woven web 56 is suitably reeled off by a reeler (not shown). By such an arrangement, the build-up of toner at an abutting portion with respect to the fixing roller 39 can be prevented.

The transfer material, on which a full-color fixed image is formed after passing through the heat-pressure-fixing device 9, is delivered to a tray 10. In the above image forming process, a color toner image containing at least the toner of the present invention is fixed on the transfer material to form a color image thereon.

In the above description, as one of the embodiments of the image forming method using the toner of the present invention, the image forming method using the image forming apparatus equipped with the four developing devices for four colors for one image bearing member has been described with reference to FIG. 1. However, the image forming method in the present invention is not limited to one using such an image forming apparatus. For example, the image forming method in the present invention may be one using a tandem type image forming apparatus in which developing devices for four colors are arranged on different image bearing members and toner images formed on the respective image bearing members are transferred sequentially on the transfer material.

The image forming method using the toner of the present invention may be one using an image forming apparatus in which a toner image is directly transferred to a transfer material from the toner image formed on an image bearing member, or one using an image forming apparatus in which a toner image on an image bearing member is transferred to an intermediate transfer member, and then transferred from the intermediate transfer member to a transfer material. Further, the shape of the above-mentioned intermediate transfer member is not particularly limited. It may be a drum-shaped intermediate transfer member, or may be an endless intermediate transfer member formed of a belt.

A process cartridge capable of using the toner of the present invention may include an image bearing member and developing means. The developing means receives the toner of the present invention. The process cartridge is not particularly limited as far as it is structured to have structural components in one piece and such an integrated structure is structured to be detachably attached to an image forming apparatus main body. Therefore, such a process cartridge can be realized using the well-known structure of the process cartridge. For example, the process cartridge may be an image forming unit for each color which is provided to the tandem type image forming apparatus and has an image bearing member, a developing device, and cleaning means for the image bearing member.

Hereinafter, a favorable measuring method of measuring each physical property of the resin used in the present invention and the toner of the present invention is described.

(1) Measurement of Molecular Weight of THF Soluble Fraction of Toner and Resin by GPC Measurement A column is stabilized in a heat chamber at 40° C. THF is provided as a solvent and made to flow through the column heated at that temperature at a flow rate of 1 ml/min, and approximately 100 μl of a THF sample solution is injected to the column for the measurement. A detector used is a refractive index (RI) detector. As a column, a combination of a plurality of styrene gel columns commercially available can be preferably used. For example, it may be a combination of Shodex GPC KF-801, 802, 803, 804, 805, 806, 807, and 800P, manufactured by Showa Denko K.K., or a combination of TSK gel G1000H (HXL), G2000H (HXL), G3000H (HXL), G4000H (HXL), G5000H (HXL), G6000H (HXL), G7000H (HXL), and TSK guard column, manufactured by Tosoh Corporation.

The THF sample solution is prepared as follows.

A sample is added to THF, left to stand for several hours, and then sufficiently shaken to mix the sample with THF well until the aggregation of the sample disappears. Then, the mixture is left to stand for additional 12 hours or more such that total THF immersion time becomes 24 hours or more. After that, the sample is passed through a sample-treatment filter (0.2 to 0.5 μm in pore size, such as Mysho-ridisk H-25-2 manufactured by Tosoh Corporation) to be provided as a THF sample solution for GPC. The concentration of the sample is adjusted such that the content of the resin component thereof becomes 0.5 to 5 mg/ml.

For measuring the molecular weight of the sample, the molecular weight distribution of the sample is calculated from the relationship between a logarithmic value and a count value of the analytical curve prepared by several kinds of monodispersed polystyrene standard sample. The standard polystyrene sample for preparing the analytical curve may be one having a molecular weight of approximately $10^2$ to $10^7$, manufactured by Tosoh Corporation or Showa Denko K.K. It is favorable to use at least about 10 standard polystyrene samples.

(2) Measurement on THF Insoluble Fraction

A toner sample is accurately measured in a range of 0.5 to 1.0 g and is then placed in a filter paper thimble (No. 86R, manufactured by Toyo Roshi Kaisha, Ltd., dimensions: 28 mm in outer diameter and 100 mm in height), followed by subjecting to a Soxhlet abstractor. 200 ml of THF as an extraction solvent is used. For the extraction, the temperature of an oil bath is adjusted in a range of 120 to 130° C., and a time required for one reflux is adjusted in a range of 120 to 150 seconds. A time period required for the extraction is set to 10 hours. After completing the extraction, the filter paper thimble is dried for 10 hours at 50° C. under reduced pressure, and the THF insoluble fraction is calculated from the following equation.

$$THF \text{ insoluble fraction (Weight \%)} = \frac{\{W_1 - (W_2 + W_3)\}}{W_1 - W_3} \times 100$$

In the equation, $W_1$ is the mass of the sample, $W_2$ is the mass of the THF soluble fraction in the resin included in the toner, and $W_3$ is the mass of components other than the resin included in the toner (e.g., pigment, wax, or external additive).

(3) Measurements on DSC Curves of Toner and Resin

According to ASTM D3418-82, the measurement is performed using a differential scanning calorimeter DSC 2920 (DSC measuring device) (manufactured by TA Instruments Co., Ltd.).

5 mg of the sample to be measured is precisely scaled and then placed in an aluminum pan, while an empty aluminum pan is prepared as a reference. The measurement is performed at a temperature ranging from 30 to 200° C. with a temperature rising rate of 10° C./min. During the period of temperature rising, the DSC curve was measured at a temperature of 60 to 200° C. From the DSC curve, the glass transition temperature (Tg) can be obtained.

(4) Measurement of the Deformation of Toner 5 to 5.5 g of toner is pressurized for 2 minutes at a pressure of 81.6 kgf/cm$^2$ (800 N/cm$^2$) using a tablet molding device to mold a cylindrical sample of 25 mm in diameter and 10 to 11 mm in height. As a measuring device, ARES (viscoelasticity measurement equipment, manufactured by Rheometric Scientific F.E. Ltd) equipped with a parallel plate of 25 mm in diameter, which is made of stainless steel (SUS) and coated with PTFE of 20 to 40 μm in thickness, is used.

In the measuring method of deformation, the molding sample of a toner is set in the parallel plate coated with the PTFE, and an atmospheric temperature is controlled to 120° C. Under such conditions, the sample is left to stand for 5 minutes and the height of the sample (gap) was adjusted to 10.000 mm. Rate Mode Test of Multiple Extension Mode Test is selected. The toner molding sample is compressed at a rate of −0.5 mm/sec. Then, the relationship between the height (gap) of the sample and the load (normal force) is measured. When the height (gap) of the sample at a normal force of 500 g is defined as $G_{500}$ (mm), the toner deformation ($R_{500}$) is calculated from the following equation.

$$R_{500} = \frac{10.000 - G_{500}}{10.000} \times 100$$

(5) Measurement on Volume Average Particle Diameter of Resin Emulsion Particle

The resin emulsion was appropriately diluted with water, and the distribution of particle diameter was measured using Microtrac UPA (manufactured by Nikkiso Co., Ltd.). The volume average particle diameter of the resin emulsion can be measured.

(6) Measurement on Volume Average Particle Diameter of Yellow Pigment in Toner Particle 5 ml of THF (tetrahydrofuran) is added to 100 mg of toner and then left to stand for 24 hours. Immediately after that, the sample is processed with an ultrasonic dispenser for 1 minute to disperse a monoazo yellow pigment in THF. The distribution of the particle diameter of the sample thus obtained is measured using Microtrac UPA (manufactured by Nikkiso Co., Ltd.). As a result of the measurement, the volume average particle diameter of the monoazo yellow pigment included in the toner particle and the ratio (% by volume) of a monoazo yellow pigment having a particle diameter of 300 nm can be obtained.

EXAMPLES

The present invention will be explained by way of examples. However, the present invention is not limited to these examples. Here, "part" means "part by mass".

[Preparation of Water-Soluble Styrene-Acryl Resin (1)]

200 parts of xylene; 56 parts of styrene, 36 parts of acrylic acid, and 8 parts of butyl acrylate as monomers; and 5 parts of di-t-butyl peroxide as a polymerization initiator were added into a reaction container equipped with a reflux tube, an agitator, a thermometer, a nitrogen gas in-take tube, a dropping device, and a pressure-reducing device, followed by perform a radical polymerization reaction at 120° C. for 8 hours. Subsequently, the resulting product was dried. As a result, a water-soluble styrene-acryl resin (1) (peak molecular weight: 7,200, Tg: 62° C., and acid value: 70 mgKOH/g) was obtained.

[Preparation of Water-Soluble Polyester Resin (1)]

50 parts of terephthalic acid, 50 parts of isophthalic acid, 34 parts of 1,4-cyclohexanedicarboxylic acid, 54 parts of 5-dimethyl sulfoisophthalate sodium salt, 76 parts of ethylene glycol, and 0.2 part of dibutyltin oxide were added in a 4-litter four-neck flask made of glass. Then, a thermometer, a stirring rod, and a condenser were attached on the four-neck flask. Then, the flask was placed in a mantle heater. While stirring a solution in the flask, the solution was gradually heated. A reaction was conducted at 200° C. for 4 hours. Accordingly, a water-soluble polyester resin (1) (peak molecular weight: 8500, Tg: 58° C., and acid value: 0 mgKOH/g) was obtained.

[Preparation of Water-Soluble Hybrid Resin (1)]

In a reaction container equipped with a reflux tube, an agitator, a thermometer, a nitrogen gas in-take tube, a dropping device, and a pressure-reducing device, 70 parts of the above water-soluble polyester resin (1) was added together with 200 parts of xylene. Then, the reaction container was heated up to 135° C., while introducing nitrogen into the container.

A monomer mixture including 15 parts of styrene, 10 parts of acrylic acid, and 5 parts of butyl acrylate, which form a vinyl polymer unit, and 1 part of di-t-butyl peroxide as a polymerization initiator was added to the above reaction container to allow a radical polymerization reaction for 8 hours. As a result, a water-soluble hybrid resin (1) (a composition ratio of a polyester component and a styrene-acryl component: 7:3, peak molecular weight: 8,500, Tg: 62° C., and acid value: 62 mgKOH/g) was obtained.

[Preparation of Styrene-Acryl Resin Emulsion (1)]

50 parts of ion-exchanged water was poured in a flask, followed by dissolving 3 parts of sodium dodecylbenzene sulfonate therein. Then, a mixture solution containing 36 parts of styrene, 4 parts of n-butyl acrylate, and 1 part of acrylic acid was dropped with stirring into the flask to emulsify it. Subsequently, 5 parts of ion-exchanged water in which 0.5 part of ammonium persulfate was dissolved, was dropped into the emulsion, followed by reacting the resulting mixture at 80° C. for 4 hours. As a result, a styrene-acryl resin emulsion (1) (resin solids content: 30%, volume average particle diameter of resin particles: 210 nm, peak molecular weight: 54,000, Tg: 68° C., acid value: 15 mgKOH/g) was obtained.

[Preparation of Polyester Resin Emulsion (1)]

In a four-neck flask made of glass, 68 parts of polyoxypropylene(2.2)-2,2-bis(4-hydroxyphenyl)propane, 23 parts of terephthalic acid, 7 parts of fumaric acid, 1.5 parts of trimellitic acid, and 0.1 part of dibutyltin oxide were added. Then, a thermometer, a stirring rod, and a condenser were attached on the four-neck flask. The flask was then placed in a mantle heater. While being stirred in the flask, the solution was gradually heated. A reaction was conducted at 200° C.

for 4 hours. Accordingly, a polyester resin (2), having a peak molecular weight (Mp) of 5,800 was obtained.

Subsequently, 100 parts of the polyester resin (2) and 150 parts of tetrahydrofuran were added in a flask and were stirred and dissolved. Then, 5 parts of a 40 mass % potassium hydroxide solution was added. While stirring the mixture, 700 parts of water was further added. Under nitrogen substitution, the resulting solution was heated to 65° C. and retained for 1 hour to remove the tetrahydrofuran. Accordingly, a polyester resin emulsion (1) (resin solids content: 30%, volume average particle diameter of resin particle: 46 nm, peak molecular weight: 4,600, Tg: 52° C., acid value: 6 mgKOH/g) was obtained.

[Preparation of Hybrid Resin Emulsion (1)]

In a reaction container equipped with a reflux tube, an agitator, a thermometer, a nitrogen gas in-take tube, a dropping device, and a pressure-reducing device, 50 parts of the polyester resin (2) was added together with 200 parts of xylene, and then a mixture was heated to 135° C. while introducing nitrogen.

A monomer mixture containing 37 parts of styrene and 13 parts of butyl acrylate, which form a vinyl polymer unit, and 1 part of di-t-butyl peroxide as a polymerization initiator was added to the above reaction container to conduct a radical polymerization reaction for 8 hours. As a result, a hybrid resin was obtained.

Subsequently, 100 parts of the above hybrid resin and 150 parts of tetrahydrofuran were added in a flask and then stirred and dissolved. Then, 5 parts of a 40 mass % potassium hydroxide solution was added. Furthermore, while stirring the mixture, 700 parts of water was added. Under nitrogen substitution, the resulting solution was heated to 65° C. and retained for 1 hour to remove the tetrahydrofuran. Accordingly, a hybrid resin emulsion (1) (resin solids content: 33%, volume average particle diameter of resin particle: 92 nm, peak molecular weight: 18,600, Tg: 65° C., acid value: 8 mgKOH/g) was obtained.

[Preparation of Press Cake (1)]

At first, 22 parts of 4-nitro-o-anisidine was dissolved in 38 parts of a 35 mass % aqueous hydrochloric acid, and the aqueous solution was then cooled to 0 to 5° C. Subsequently, a solution prepared by dissolving 10 parts of sodium nitrite in 15 parts of water was dropped into the aqueous solution, resulting in a diazo component solution.

Then, 45 parts of water was added to 10 parts of the water-soluble styrene-acrylic resin (1), followed by dropping 5 parts of a 10% aqueous sodium hydroxide. The resin was dissolved while agitating to obtain a water-soluble resin solution.

Further, 30 parts of o-methoxy acetoacetanilide and 58 parts of sodium acetate were dissolved in 100 parts of water. Then, the water-soluble resin solution was added to the aqueous solution, resulting in a solution containing a coupler component and the water-soluble resin.

The solution containing the coupler component and the water-soluble resin solution was kept at the room temperature, while dropping the diazo component solution to initiate a coupling reaction. Next, the solution was heated to 90° C., followed by agitating for 30 minutes. Further, a 35% aqueous hydrochloric acid solution was added to adjust the pH of the solution to pH=4. The resultant precipitate was filtrated and washed, and then subjected to a filter press, resulting in a press cake (1) having a water content of 63% and containing the pigment represented by the formula (2) and the water-soluble resin.

The amount of the water-soluble styrene-acrylic resin (1) used was 50 parts by mass with respect to 100 parts by dry mass of the resultant yellow pigment.

[Preparation of Press Cake (2)]

At first, 22 parts of 4-nitro-o-anisidine was dissolved in 38 parts of a 35% aqueous hydrochloric acid, and the aqueous solution was then cooled to 0 to 5° C. Subsequently, a solution prepared by dissolving 10 parts of sodium nitrite in 15 parts of water was dropped into the aqueous solution, resulting in a diazo component solution.

Then, 100 parts of water was added to 30 parts of o-methoxy acetoacetanilide and 58 parts of sodium acetate, followed by dissolving to obtain a coupler component solution.

Further, 70 parts of water was added to 20 parts of water-soluble styrene-acrylic resin (1) used in the preparation of press cake (1). Then, 5 parts of a 10% aqueous sodium hydroxide was dropped into the solution, and then the mixture was stirred to dissolve the resin. In the solution kept at the room temperature, the diazo component solution and the coupler component solution were simultaneously dropped to conduct a coupling reaction. Next, the temperature of the solution was rised to 90° C., and stirred for 30 minutes. This solution was adjusted to pH=4 by adding a 35% aqueous hydrochloric acid solution. The resultant precipitate was filtrated and washed, followed by subjecting to a filter press. As a result, a press cake (2) having a water content of 60% and containing the pigment represented by the formula (2) and the water-soluble resin was obtained.

The amount of the water-soluble styrene-acrylic resin (1) used was 47 parts by mass with respect to 100 parts by dry mass of the resultant yellow pigment.

[Preparation of Press Cake (3)]

At first, 22 parts of 4-nitro-o-anisidine was dissolved in 38 parts of a 35% aqueous hydrochloric acid, and the aqueous solution was then cooled to 0 to 5° C. Subsequently, a solution prepared by dissolving 10 parts of sodium nitrite in 15 parts of water was dropped into the aqueous solution, resulting in a diazo component solution.

Then, 100 parts of water was added to 30 parts of o-methoxy acetoacetanilide and 58 parts of sodium acetate, followed by dissolving to obtain a coupler component solution.

Furthermore, 70 parts of water is added to 10 parts of water-soluble styrene-acrylic resin (1) used in the preparation of press cake (1). Then, 5 parts of a 10% sodium hydroxide aqueous solution was dropped into the solution, and then the mixture was stirred to dissolve the resin, resulting in a water-soluble resin solution.

The coupler component solution was kept at the room temperature, while dropping the diazo component solution to conduct a coupling reaction. After dropping 5% by mass of the diazo component solution, the water-soluble resin solution is also dropped to further progress the coupling reaction. Next, the temperature of the solution is rised to 90° C. and stirred for 30 minutes. Further, a 35% aqueous hydrochloric acid solution was added, and the solution was adjusted to pH=4. The resultant precipitate was filtrated and washed, and then subjected to a filter press, resulting in a press cake (3) having a water content of 57% and containing the pigment represented by the formula (2) and the water-soluble resin.

The amount of the water-soluble styrene-acrylic resin (1) used was 56 parts by mass with respect to 100 parts by dry mass of the resultant yellow pigment.

[Preparation of Press Cake (4)]

A press cake (4) having a water content of 65% was prepared in the same manner as that of the press cake (1), except that the water-soluble hybrid resin (1), which is prepared by forming a graft polymer from a polyester unit and a styrene-acrylic resin unit, was used instead of the water-soluble styrene-acrylic resin (1).

The amount of the water-soluble hybrid resin (1) used was 50 parts by mass with respect to 100 parts by dry mass of the resultant yellow pigment.

[Preparation of Press Cake (5)]

A press cake (5) having a water content of 71% was prepared in the same manner as that of the press cake (1), except that the water-soluble polyester resin (1) was used instead of the water-soluble styrene-acrylic resin (1).

The amount of the water-soluble polyester resin (1) used was 61 parts by mass with respect to 100 parts by dry mass of the resultant yellow pigment.

[Preparation of Press Cake (6)]

At first, 22 parts of 4-nitro-o-anisidine was dissolved in 38 parts of a 35% hydrochloric acid aqueous solution, and the aqueous solution was then cooled to 0 to 5° C. Subsequently, a solution prepared by dissolving 10 parts of sodium nitrite in 15 parts of water was dropped into the aqueous solution, resulting in a diazo component solution.

30 parts of o-methoxy acetoacetanilide and 58 parts of sodium acetate-were dissolved in 100 parts of water. In a resultant solution, 33 parts of the styrene-acrylic resin emulsion (1) was added. Accordingly, a solution containing a coupler component and the resin emulsion was obtained.

The solution containing the coupler component and the resin emulsion was kept at the room temperature, while dropping the diazo component solution to initiate a coupling reaction. Next, the temperature of the solution is rised to 90° C., and then stierred for 30 minutes. Further, a 35% aqueous hydrochloric acid solution was added to adjust the pH of the solution to pH=4. The resultant precipitate was filtrated and washed, and then subjected to a filter press, resulting in a press cake (6) having a water content of 68% and containing the pigment represented by the formula (2) and the resin emulsion.

The amount of the stylene-acryl resin emulsion (1) used was 61 parts by mass with respect to 100 parts by dry mass of the resultant yellow pigment.

[Preparation of Press Cake (7)]

A press cake (7) having a water content of 62% was prepared in the same manner as that of the press cake (6), except that the hybrid resin emulsion (2), which is prepared by forming a graft polymer from a polyester unit and a styrene-acrylic resin unit, was used instead of 10 parts of the styrene-acryl resin emulsion (1).

[Preparation of Press Cake (8)]

A press cake (8) having a water content of 66% was prepared in the same manner as that of the press cake (6), except that the polyester resin emulsion (3) was used instead of 10 parts of the styrene-acryl resin emulsion (1).

[Preparation of Press Cake (9)]

16.8 parts of 4-nitro-o-anisidine was added to a mixture of 60 parts water and 100 parts 10% hydrochloric acid, and the mixture was then stirred, followed by cooling to 0° C. Then, a solution prepared by dissolving 7.5 parts of sodium nitrite in 10 parts of water was dropped into the mixture, resulting in a diazo component solution.

18.6 parts of o-methoxy acetoacetanilide and 2.4 parts of 5-acetoacetyl amino benzimidazolone were added to 500 parts of water, followed by dissolving 4.8 parts of sodium hydroxide therein. Subsequently, 20 parts of a 20% water dispersion of the water-soluble polyester resin (1) was added to the mixture, followed by adding a mixture of 12 parts of acetic acid and 12 parts of water to precipitate a product. Accordingly, a solution containing a coupler component and the water-soluble resin was obtained.

The solution containing the coupler component and the water-soluble resin was kept at the room temperature, while dropping the diazo component solution to initiate a coupling reaction. Next, the temperature of the solution is rised to 90° C., followed by agitating for 30 minutes. Further, a 35% aqueous hydrochloric acid solution was added to adjust the pH of the solution to pH=4. The resultant precipitate was filtrated and washed, and then subjected to a filter press, resulting in a press cake (9) having a water content of 68% and containing the pigment represented by the formula (2), the pigment represented by the formula (15), and the water-soluble resin.

[Preparation of Press Cake (10)]

15.1 parts of 4-nitro-anisidine and 2.2 parts of 2-aminon-aphthalene-1-sulfonic acid were added to a mixture of 60 parts water and 100 parts of 10% hydrochloric acid, and the mixture was then stirred, followed by cooling to 0° C. Then, a solution prepared by dissolving 7.5 parts of sodium nitrite in 10 parts of water was dropped into the mixture, resulting in a diazo component solution.

20.7 parts of o-methoxy acetoacetanilide was added to 500 parts of water, followed by dissolving 4.8 parts of sodium hydroxide therein. Subsequently, 20 parts of a 20% water dispersion of the water-soluble polyester resin (1) was added to the mixture, followed by adding a mixture of 12 parts of acetic acid and 12 parts of water to precipitate a product. Accordingly, a solution containing a coupler component and the water-soluble resin was obtained.

The solution containing the coupler component and the water-soluble resin was kept at the room temperature, while dropping a diazo component solution to initiate a coupling reaction. Next, the temperature of the solution is rised to 90° C., followed by agitating for 30 minutes. Further, a 35% aqueous hydrochloric acid solution was added to adjust the pH of the solution to pH=4. The resultant precipitate was filtrated and washed, and then subjected to a filter press, resulting in a press cake (10) having a water content of 64% and containing the pigment represented by the formula (5) and the water-soluble resin.

[Preparation of Comparative Press Cake (1)]

At first, 22 parts of 4-nitro-o-anisidine was dissolved in 38 parts of a 35% hydrochloric acid aqueous solution, and the aqueous solution was then cooled to 0 to 5° C. Subsequently, a solution prepared by dissolving 10 parts of sodium nitrite in 15 parts of water was dropped into the aqueous solution, resulting in a diazo component solution.

Then, 30 parts of o-methoxy acetoacetanilide and 58 parts of sodium acetate were dissolved to 150 parts of water, followed by dissolving to obtain a coupler component solution.

The coupler component solution was kept at the room temperature, while dropping the diazo component solution for over 90 minutes to initiate a coupling reaction. Next, the temperature of the solution is rised to 90° C., followed by agitating for 30 minutes. Further, a 35% aqueous hydrochloric acid solution was added to adjust the pH of the solution to pH=4. The resultant precipitate was filtrated and washed, and then subjected to a filter press, resulting in a comparative press cake (1) having a water content of 53% and containing the pigment represented by the formula (2).

[Preparation of Comparative Press Cake (2)]

At first, 20 parts of 4-nitro-o-anisidine and 2 parts of 5-aminobenzimidazolon were dissolved in 38 parts of a 35% hydrochloric acid aqueous solution, and the aqueous solution was then cooled to 0 to 5° C. Subsequently, a solution prepared by dissolving 10 parts of sodium nitrite in 15 parts of water was dropped into the aqueous solution, resulting in a diazo component solution.

Further, 27 parts of o-methoxy acetoanilide, 3 parts of 4-acetoacetyl aminobenzene sulfonic acid, and 58 parts of sodium acetate were dissolved in 150 parts of water to obtain a coupler component solution.

The coupler component solution was kept at the room temperature, while dropping the diazo component solution to initiate a coupling reaction. Next, the temperature of the solution is rised to 90° C., followed by agitating for 30 minutes. Further, a 35% aqueous hydrochloric acid solution was added to adjust the pH of the solution to pH=4. The resultant precipitate was filtrated and washed, and then subjected to a filter press, resulting in a press cake (2) having a water content of 71% and containing the following pigment.

the pigment represented by the formula (2)

the pigment represented by the formula (16)

Pigment represented by following formula (24)

Formula (24)

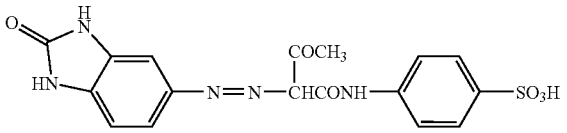

Pigment represented by following formula (25)

Formula (25)

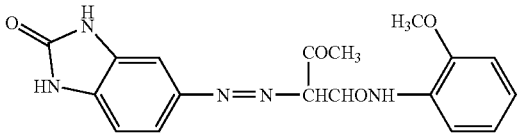

Table 2 shows the prescription of a resin used for manufacturing each of the obtained press cakes (1) to (10) and the comparative press cakes (1) and (2).

TABLE 2

| | Yellow pigment contained | Resin used |
|---|---|---|
| Press cake (1) | Compound of formula (2) | Water-soluble styrene-acrylic resin (1) |
| Press cake (2) | Compound of formula (2) | Water-soluble styrene-acrylic resin (1) |
| Press cake (3) | Compound of formula (2) | Water-soluble styrene-acrylic resin (1) |
| Press cake (4) | Compound of formula (2) | Water-soluble hybrid resin (1) |
| Press cake (5) | Compound of formula (2) | Water-soluble polyester resin (1) |

TABLE 2-continued

| | Yellow pigment contained | Resin used |
|---|---|---|
| Press cake (6) | Compound of formula (2) | Styrene-acrylic resin emulsion (1) |
| Press cake (7) | Compound of formula (2) | Hybrid resin emulsion (1) |
| Press cake (8) | Compound of formula (2) | Polyester resin emulsion (1) |
| Press cake (9) | Compound of formula (2) and (15) | Water-soluble polyester resin (1) |
| Press cake (10) | Compound of formula (2) and (5) | Water-soluble polyester resin (1) |
| Comparative press cake (1) | Compound of formula (2) | none |
| Comparative press cake (2) | Compound of formula (24) and (25) | none |

Example 1

In a four-neck flask made of glass, 30 parts of polyoxyethylene (2.2)-2,2-bis(4-hydroxyphenyl)propane, 33 parts of polyoxypropylene(2.2)-2,2-bis(4-hydroxyphenyl) propane, 21 parts of terephthalic acid, 3 parts of fumaric acid, 1 part of trimellitic acid, 12 parts of dodecenylsuccinic acid, and 0.1 part of dibutyltin oxide were added. Then, a thermometer, a stirring rod, and a condenser were attached on the four-neck flask. The flask was then placed in a mantle heater. While stirring a solution in the flask, the solution was gradually heated to allow a reaction at 200° C. for 6 hours. Accordingly, an unsaturated polyester resin (A) (peak molecular weight: 8,700, Mw/Mn=3.6, Tg: 62° C., and acid value: 6 mgKOH/g) was obtained.

70 parts of the above polyester resin (A) and 200 parts of xylene were supplied to a reaction container comprising a reflux condenser, an agitator, a thermometer, a nitrogen gas in-take tube, a dropping device, and a pressure-reducing device and heated to 135° C. while introducing nitrogen.

A monomer mixture including 24 parts of styrene, 4 parts of butyl acrylate, 2 parts of monobutyl maleate, which form a vinyl polymer unit, and 2 parts of monobutyl peroxide as a polymerization initiator was added to the above reaction container to allow a radical polymerization reaction for 8 hours A solution mixture containing a hybrid resin, in which a vinyl polymer unit is grafted on a unsaturated polyester unit, as a main component, as well as a saturated polyester and the vinyl polymer is obtained.

Under reduced pressure, xylene was distilled off to obtain a hybrid resin composition (A) mainly comprising the above hybrid resin. The hybrid resin composition (A) has a main peak at a molecular weight of 8,200 and an Mw/Mn ratio of 4.2, a glass transition temperature of 60° C., an acid value of 21 mgKOH/g.

| | |
|---|---|
| Press cake (1) | 120 parts |
| Hybrid resin composition (A) | 60 parts |

The above raw materials were placed in a kneader type mixer and pre-mixed for 5 minutes at glass transition temperature of the resin or below, followed by heating to 100° C. while mixing. The mixture was further heated to 120° C. while removing a water content separated from a resin layer. A melt-kneading was performed under heat for about 30 minutes to allow the pigment to migrate into the resin. Subsequently, the mixture was cooled and removed from the mixer. Then, the mixture was further subjected to kneading under heat with a triple roll mill to disperse the pigment. The resultant product was dried and pulverized. As a result, a pigment composition (A) containing a 40% pigment content was obtained.

| | |
|---|---|
| Pigment composition (A) | 20 parts |
| Hybrid resin composition (A) | 100 parts |
| Paraffin wax (DSC endothermic peak: 78° C.) | 5 parts |
| di-tert butyl aluminum salicylate compound | 1 part |

The mixture of the above raw materials was sufficiently premixed by a Henschel mixer. Then, by using a double-screw extruder, the mixture heated to 120° C. was melted and kneaded. After cooling, using a hammer mill, the mixture was roughly pulverized into particles having a particle diameter of approximately 1 to 2 mm. Subsequently, using an air-jet type pulverizer, the particles were pulverized into fine particles. Further, the resultant fine particles were classified by a multi-division classifier, resulting in yellow toner particles having a volume average particle diameter of 6.8 μm.

A yellow toner (1) was prepared by combining 100 parts of yellow toner particles classified in the above classification step with 1.0 part of hydrophobic titanium oxide (BET specific surface area: 110 $m^2/g$) treated with n-$C_4H_9Si(OCH_3)_3$. When the THF insoluble fraction of the yellow toner (1) was measured, the toner contained 16% by mass of such a fraction with respect to 100% by mass of the binder resin. In addition, when the molecular weight of the THF soluble fraction was measured, the toner had a main peak at a molecular weight of 8,400, and a ratio (Mw/Mn) of the weight average molecular weight (Mw) to the number average molecular weight (Mn) of 6.

The dispersed particle diameter of the pigment in the above yellow toner (1) was measured as 141 nm on the basis of volume. In addition, the percentage of pigments having a particle diameter of 300 nm or more was 7% by volume on the basis of the total pigment.

A deformation $R_{500}$ of the yellow toner (1) at 120° C. was measured and a satisfactory value of 78% was obtained.

The physical properties of the yellow toner (1) are shown in Table 3.

A two-component yellow developer 1 was prepared by mixing the yellow toner (1) with magnetic ferrite carrier particles (50 μm in average particle diameter) surface-coated with a silicone resin such that the concentration of toner was 8% by mass.

Using this two-component yellow developer 1, unfixed images were formed on CLC color copy paper (manufactured by Canon Inc.) with a basis weight of 80 $g/cm^2$ and an OHP transparency sheet (CG3700, manufactured by SUMITOMO 3M Limited) by a color copier CLC-1000 (manufactured by Canon Inc.). As an image, a solid image in which the load of toner per unit area was varied from 0.4 $mg/cm^2$ to 1.0 $mg/cm^2$ at seven steps of 0.1 $mg/cm^2$ was prepared.

The unfixed image thus obtained was placed in an oven at 130° C. and then left at rest for 1 minute to fix the image. The resulting image was evaluated as follows.

(Chromaticity Measurement of Image Formed on Paper)

CIE a* and b* of the image obtained on the color copy paper were measured using the Spectroscan manufactured by Gretag Macbeth (measurement conditions: D65, a viewing angle of 2°). Chromaticity values were plotted for the seven-stepped loads of the toner, and then a curve was drawn to smoothly connect one point to another point. Subsequently, on the curve, the value of a*, at which the value of b* was 80, was read out.

Figure 3:
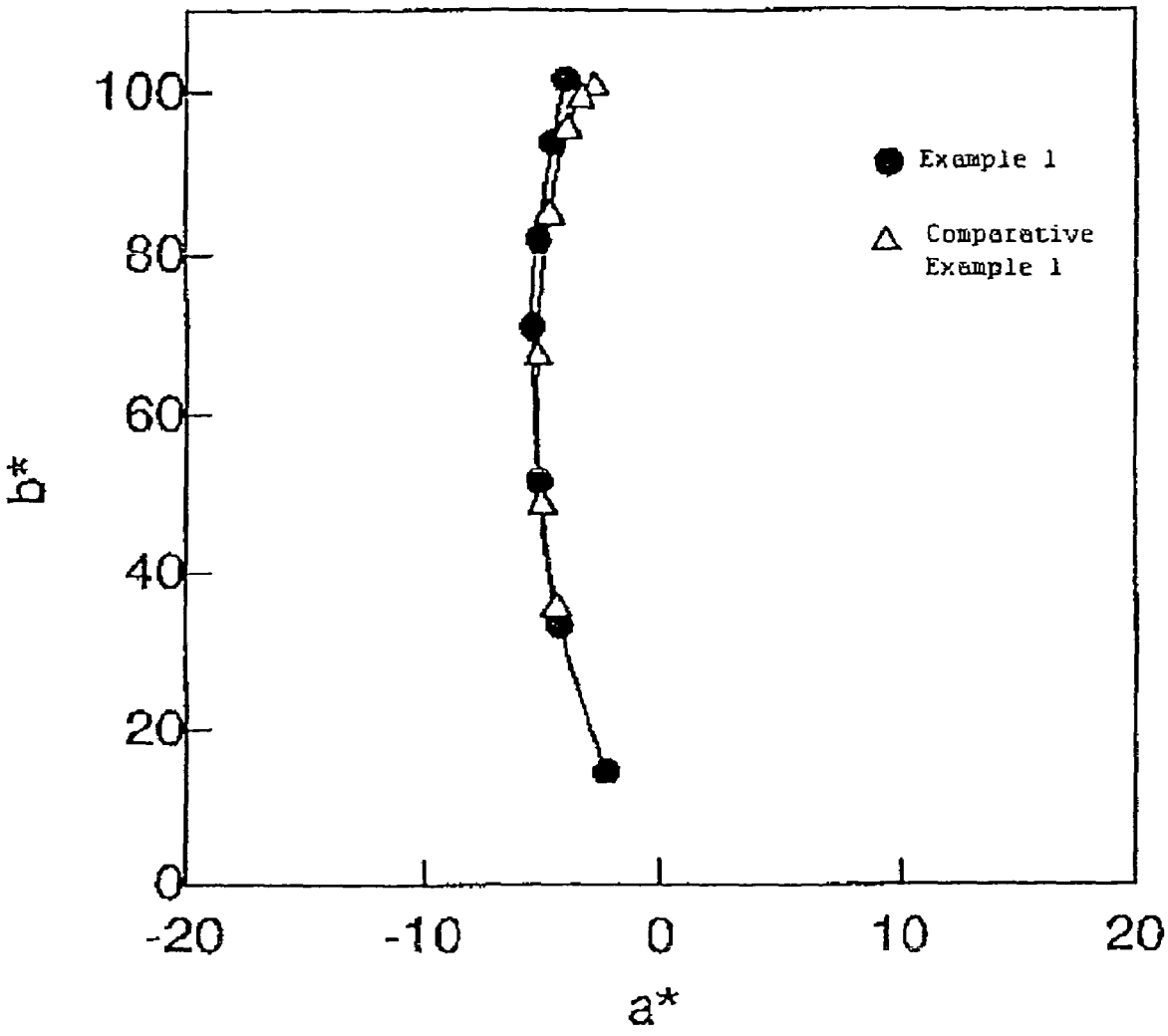
FIG. 3 is a graph showing a chromaticity of an image formed on a sheet of paper using each of toners according to Example 1 and Comparative Example 1.

The evaluation results obtained using the images formed in Example 1 are shown in Table 4. Also, FIG. 3 shows a graph of a* vs. b*.

(Chromaticity Measurement of OHP-Projected Image)

An image was formed on an OHP transparency sheet, and the formed image was projected on a white wall surface using an OHP (Overhead projector Model 9550; manufactured by SUMITOMO 3M Limited). Then, CIE a* and b* of the projected image were measured using the spectroradiometer (PR650; manufactured by Photo Research Co., Ltd.). Chromaticity values were plotted for the seven-stepped loads, and then a curve was drawn to smoothly connect one point to another point. Subsequently, on the curve, the value of a*, on which the value of b* was 80, was read out.

Figure 4:
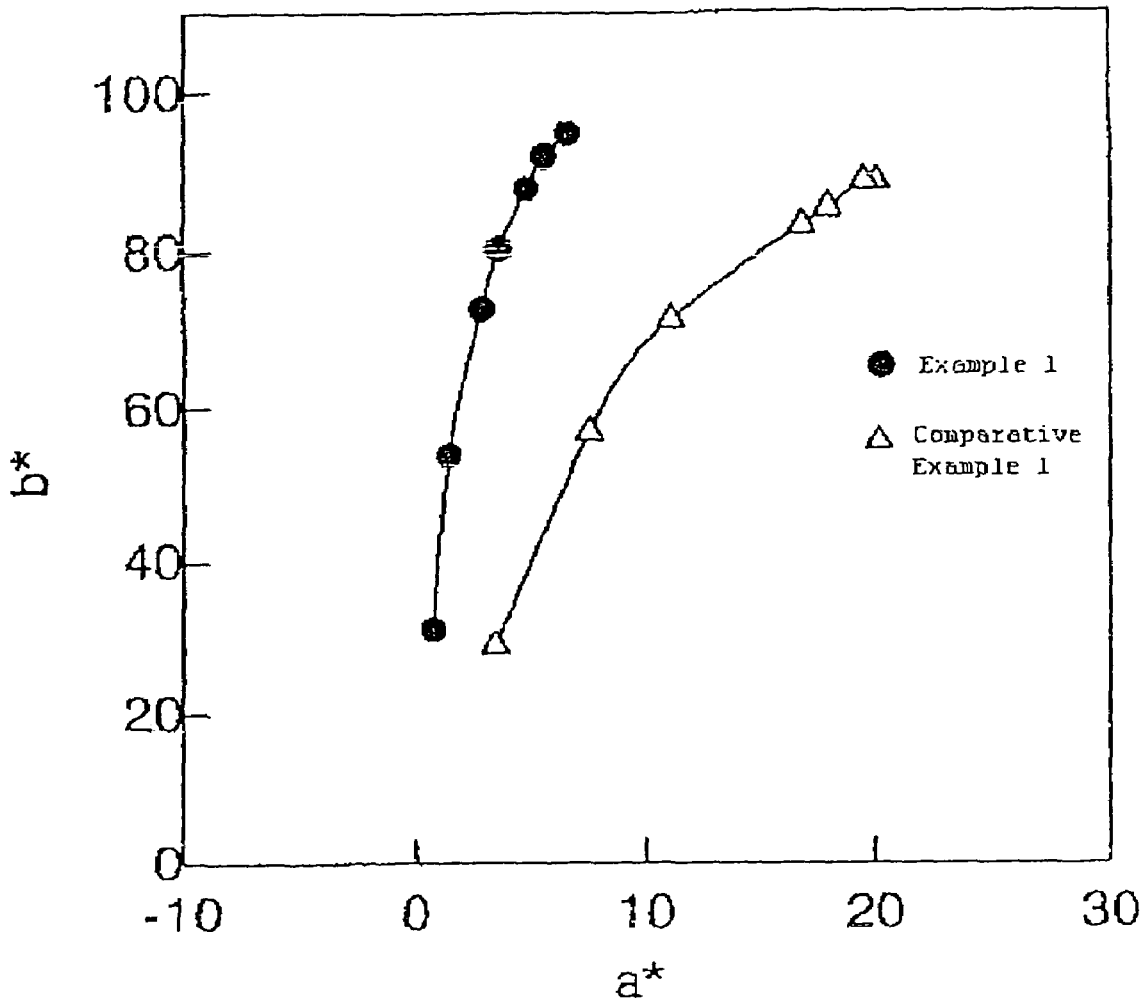
FIG. 4 is a graph showing a chromaticity of an image projected on a screen through an OHP, the image being originally formed on a transparency sheet using each of the toners according to Example 1 and Comparative Example 1.

The evaluation results obtained using the images formed in Example 1 are shown in Table 4. Also, FIG. 4 shows a graph of a* vs. b* is shown.

The resulting image had good reflected colors and also had a visually-preferable chromaticity as a yellow toner even in the form of OHP-projected image. Also, the resulting image was clear with a good transparency.

Example 2

A yellow toner (2) was obtained in the same manner as that of Example 1, except that the polyester resin (A) was used instead of the hybrid resin composition (A). The physical properties of the yellow toner (2) are shown in Table 3, and the results evaluated in the same manner as that of Example 1 are shown in Table 4.

Example 3

In a four-neck flask made of glass, 33 parts of polyoxypropylene(2.2)-2,2-bis(4-hydroxyphenyl)propane, 21 parts of terephthalic acid, 6 parts of isophthalic acid, 8 parts of fumaric acid, 1 part of trimellitic acid, and 0.1 part of dibutyltin oxide were added. Then, a thermometer, a stirring rod, and a condenser were attached to the four-neck flask, and the flask was then placed in a mantle heater. While stirring a solution in the flask, the solution was gradually heated to allow a reaction at 200° C. for 6 hours. Accordingly, a polyester resin (B) (peak molecular weight: 10,500, Mw/Mn=26, Tg: 67° C., and acid value: 4 mgKOH/g) was obtained.

A yellow toner (3) was obtained in the same manner as that of Example 1, except that the polyester resin (B) was used instead of the hybridres in composition (A). The results of the yellow toner (3) evaluated in the same manner as that of Example 1 are shown in Tables 3 and 4.

Examples 4 to 12

Yellow toners (4) to (12) were obtained in the same manner as that of Example 1, except that press cakes (2) to (10) were used instead of the press cake (1). The physical properties of the yellow toners (4) to (12) are shown in Table 3, and the results evaluated in the same manner as that of Example 1 are shown in Table 4.

Comparative Examples 1 and 2

Comparative yellow toners (1) and (2) were obtained in the same manner as that of Example 1, except that comparative press cakes (1) and (2) were used instead of the press cake (1). The physical properties of the comparative yellow toners (1) and (2) are shown in Table 3, and the results evaluated in the same manner as that of Example 1 are shown in Table 4.

TABLE 3

| | Peak molecular weight of binder resin | Mw/Mn of binder resin | THF insoluble fraction (% by mass) | Toner deformation $R_{500}$ at 120° C. |
|---|---|---|---|---|
| Example 1 | 8400 | 6 | 16 | 78 |
| Example 2 | 6800 | 3 | 9 | 83 |
| Example 3 | 11600 | 34 | 24 | 72 |
| Example 4 | 8200 | 5 | 15 | 77 |
| Example 5 | 8400 | 7 | 17 | 76 |
| Example 6 | 8500 | 7 | 18 | 76 |
| Example 7 | 8700 | 5 | 17 | 75 |
| Example 8 | 8300 | 6 | 16 | 78 |
| Example 9 | 9100 | 12 | 19 | 78 |
| Example 10 | 8500 | 4 | 16 | 77 |
| Example 11 | 8600 | 8 | 17 | 78 |
| Example 12 | 8900 | 9 | 18 | 75 |
| Comparative Example 1 | 8200 | 6 | 16 | 76 |
| Comparative Example 2 | 8300 | 5 | 17 | 74 |

TABLE 4

| | At b* = 80 | | Volume average | Percentage of pigment with a |
|---|---|---|---|---|
| | a value of a* on paper | a value of a* on OHP-projected image | particle diameter of pigment (nm) | particle diameter of 300 nm or more (% by volume) |
| Example 1 | −5.1 | 4.7 | 141 | 7 |
| Example 2 | −5.3 | 7.8 | 167 | 8 |
| Example 3 | −5.3 | 11.0 | 108 | 16 |
| Example 4 | −5.0 | 8.7 | 154 | 3 |
| Example 5 | −5.1 | 13.6 | 260 | 12 |
| Example 6 | −5.2 | 0.6 | 134 | 1.8 |
| Example 7 | −5.0 | 1.2 | 173 | 9 |
| Example 8 | −4.8 | −3.4 | 143 | 6 |
| Example 9 | −4.9 | 10.6 | 203 | 17 |
| Example 10 | −5.1 | 7.3 | 187 | 12 |
| Example 11 | −7.1 | 4.3 | 106 | 0.3 |
| Example 12 | −6.5 | 3.6 | 110 | 0.5 |
| Comparative Example 1 | −4.9 | −16.4 | 315 | 29 |
| Comparative Example 2 | −10.5 | −6.4 | 57 | 37 |

What is claimed is:

1. A yellow toner comprising a yellow toner particle that contains at least a binder resin, a wax, and a yellow pigment containing a monoazo compound represented by a formula (2) as follows, wherein a value of a* is in the range of −5 to +12 when b* is +80 with respect to a transmission chromaticity of a thermally fixed image formed on a transparency sheet using the toner Formula (2)

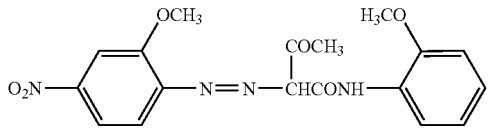

wherein the binder resin in the toner has a peak in the region from 3,000 to 15,000 in molecular weight in a chromatogram obtained by a gel permeation chromatography (GPC) and a ratio (Mw/Mn) of a weight average molecular weight (Mw) to a number average molecular weight (Mn) of from 2 to 100.

2. The yellow toner according to claim 1, wherein the binder resin comprises as a main component one of a polyester and a hybrid resin prepared by forming a graft polymer from a vinyl polymer unit and a polyester unit.

3. The yellow toner according to claim 1, wherein the wax has at least one of an endothermic peak and a shoulder in the range of 65 to 120° C. in a DSC curve during a temperature rising measured by a differential scanning calrimetry (DSC).

4. The yellow toner according to claim 1, wherein the wax has at least one of an endothermic peak and a shoulder in the range of 75 to 100° C. in a DSC curve during a temperature rising measured by a differential scanning calorimetry (DSC).

5. The yellow toner according to claim 1, wherein a deformation of the toner under a load of 500 g at 120° C. is from 75% to 80%.

6. The yellow toner according to claim 1, wherein the toner is a toner obtained by producing through a melting and kneading operation, and a pulverizing operation.

* * * * *

UNITED STATES PATENT AND TRADEMARK OFFICE

CERTIFICATE OF CORRECTION

PATENT NO. : 7,214,460 B2
APPLICATION NO. : 11/223989
DATED : May 8, 2007
INVENTOR(S) : Atsushi Ishii et al.

It is certified that error appears in the above-identified patent and that said Letters Patent is hereby corrected as shown below:

COLUMN 16:

Line 17, "2- or" should read --2-or--.

COLUMN 32:

Line 55, "hybrides in" should read --hybrid resin--.

COLUMN 34:

Line 39, "calrimetry" should read --calorimetry--.

Signed and Sealed this

Eighteenth Day of December, 2007

JON W. DUDAS
*Director of the United States Patent and Trademark Office*